US005775594A

United States Patent [19]

Tasaki et al.

[11] Patent Number: 5,775,594

[45] Date of Patent: Jul. 7, 1998

[54] SPRAYER

[75] Inventors: Takaharu Tasaki; Shigeru Hayakawa, both of Koto-ku; Mitsuhiro Sasazaki, Nasu-gun; Chitoshi Okawara, Nasu-gun; Seiichi Watanabe, Nasu-gun; Shigeru Akutsu, Nasu-gun, all of Japan

[73] Assignee: Yoshino Kogyosho Co., Ltd., Tokyo, Japan

[21] Appl. No.: 676,262

[22] PCT Filed: Dec. 5, 1995

[86] PCT No.: PCT/JP95/02482

§ 371 Date: Jul. 15, 1996

§ 102(e) Date: Jul. 15, 1996

[87] PCT Pub. No.: WO96/17690

PCT Pub. Date: Jun. 13, 1996

[30] Foreign Application Priority Data

Dec. 9, 1994 [JP] Japan ..... 6-330923

[51] Int. Cl.[6] ..... B05B 7/30

[52] U.S. Cl. ..... 239/343

[58] Field of Search ..... 239/333, 343; 222/383.1; 267/166, 166.1, 180

[56] References Cited

U.S. PATENT DOCUMENTS

| | | | |
|---|---|---|---|
| 4,153,203 | 5/1979 | Tada | 239/333 |
| 4,350,298 | 9/1982 | Tada | 239/333 |
| 4,815,663 | 3/1989 | Tada | 239/333 |
| 4,925,106 | 5/1990 | Maas et al. | 239/333 |
| 4,958,754 | 9/1990 | Dennis | 239/333 X |
| 5,366,160 | 11/1994 | Balderrama | 239/333 |
| 5,385,302 | 1/1995 | Foster et al. | 239/333 |
| 5,397,060 | 3/1995 | Maas et al. | 239/333 |
| 5,562,250 | 10/1996 | O'Neill | 239/333 X |
| 5,575,407 | 11/1996 | Foster et al. | 239/333 X |
| 5,636,768 | 6/1997 | Yamada | 222/383.1 |
| 5,645,221 | 7/1997 | Foster | 239/333 |

FOREIGN PATENT DOCUMENTS

| | | |
|---|---|---|
| A-54-82711 | 7/1979 | Japan . |
| A-56-38155 | 4/1981 | Japan . |
| U-59-158457 | 10/1984 | Japan . |
| U-62-770 | 1/1987 | Japan . |
| B2-62-59635 | 12/1987 | Japan . |
| U-63-20970 | 2/1988 | Japan . |
| A-63-49269 | 3/1988 | Japan . |
| U-64-12668 | 1/1989 | Japan . |
| U-1-110863 | 7/1989 | Japan . |
| U-3-70765 | 7/1991 | Japan . |
| U-3-83653 | 8/1991 | Japan . |
| A-6-27754 | 2/1994 | Japan . |

*Primary Examiner*—Lesley D. Morris
*Attorney, Agent, or Firm*—Oliff & Berridge, PLC.

[57] ABSTRACT

A sprayer according to the present invention is suitable for a sprayer of type which is mounted to a neck portion of a container and pumps up liquid contained in the container to spray the liquid. The term "spray" includes a meaning of spraying the liquid in the atomized state by making the liquid into fine particles and a meaning of spraying the liquid in the foamed state by further making the fine particles mixed with air. A collision plate 50 is disposed in front of a discharge nozzle 21 so that the spray state when the collision plate 50 is in the closed state and that when the collision plate 50 is in the opened state are different from each other. A first holding means 250 for holding the nozzle cover 240 in the closed state, and a opened state holding means 260 for holding the nozzle cover in the opend state are disposed between a spraying member 210 having a spraying outlet 213 and a nozzle cover 240 for opening and closing the spraying outlet 213, to prevent the nozzle cover from inadvertently closing during spraying.

10 Claims, 28 Drawing Sheets

SPRAYER

FIELD OF THE INVENTION

The present invention relates to a sprayer for spraying liquid, such as liquid detergent and insecticide contained in a container, in the atomized state or foamed state.

BACKGROUND OF THE INVENTION

There are several kinds of sprayers as disclosed in, for example, Japanese Utility Model Application Laid-Open No. 63-20970 (1988), Japanese Utility Model Application Laid-Open No. 64-12668 (1989), and Japanese Utility Model Publication No. 62-770 (1987). Such sprayers are of a so-called trigger-type. That is, such sprayers are each provided with a trigger energized (force-applied) forward by a coil spring, wherein the trigger can be pulled against elastic force of the coil spring to pressurize liquid in a pump chamber with a piston and to atomize the liquid, and then the trigger and the piston are returned by the elastic force of the coil spring to pump up liquid in the container into the pump chamber.

However, such a conventional sprayer has a problem of installing the coil spring into the sprayer while assembling the sprayer. That is, it is sometimes difficult to insert the coil spring to a hold opening for holding the coil spring because the axis of the coil spring is hard to coincide with the axis of the hold opening. Further, when the coil spring is inserted into the hold opening with the axes not coinciding with each other, the inner surface of the hold opening is sometimes scratched. Then, the coil spring touches the scratch during expansion and contraction of the coil spring, thereby disturbing the smooth expansion and contraction of the coil spring. One of the objects of the present invention is to solve this problem.

As one of the sprayers, a sprayer for foam-spraying liquid is disclosed in, for example, Japanese Patent Publication No. 62-59635 (1987). A conventional sprayer of this type sprays the liquid in a constant foaming state. That is, the sprayer can not change the foaming state for spraying. However, it may be convenient to change its foaming state in the practical use. One of the objects of the present invention is therefore to easily change its foaming state.

Furthermore, the present applicant has proposed a sprayer having a nozzle cover, which is disposed at the tip end of the spraying member having a spraying outlet at the front and center thereof to cover the spraying outlet and, the end of which is pivotably mounted to the upper end of the spraying member, wherein the sprayer is provided with holding means for holding the nozzle cover not to allow the nozzle cover to be opened while closing the spraying outlet (Japanese. Patent Application No. 6-27754 (1994)).

This sprayer can make the spraying outlet held in its closed state while not spraying. When the sprayer sprays with the nozzle cover held upwardly apart from the spraying outlet, however, there is a possibility of inadvertently pivoting the nozzle cover downward to block the spray. As the nozzle cover blocks the spray, the sprayed particles may be scattered in unexpected directions. One of the objects of the present invention is therefore to prevent the nozzle cover from inadvertently pivoting downward while spraying.

SUMMARY OF THE INVENTION

A sprayer according to the first aspect of the present invention comprises (a) a spraying member having a spraying outlet, (b) a cylinder, (c) a piston slidably inserted into the cylinder for sucking up liquid into the cylinder during the return motion, and spraying the liquid from a spraying outlet of the spraying member by pressing the liquid in the cylinder during the forward motion, and (d) a coil spring comprising a spirally wound coil wire disposed between the cylinder and the piston for energizing the piston in the returning direction, wherein a portion extending a predetermined length from each end of the coil is deflected in a direction approaching a coil axis of the coil wire, and the deflected portion is positioned on a plane perpendicular or nearly perpendicular to the coil axis of the coil wire.

The predetermined length from each end of the coil wire is measured from the end along the spiral wire. The coil axis of the coil wire means the center of the axis of the spiral shape.

The structure of the coil spring as mentioned above allows the coil spring can be installed between the cylinder and the piston while holding the correct position of the coil spring. In addition, the installed coil spring can smoothly expand and contract, thereby ensuring performing the spraying.

In a sprayer of the second aspect of the present invention, based on the first aspect, the coil spring may be set to satisfy the formula;

$$s \geqq 0.5d$$

wherein s is a deflection length of each end of the coil wire to the coil axis, and d is a wire diameter of the coil wire.

It should be noted that the coil spring in the first aspect may not in this range defined by the above formula.

A sprayer of the third aspect of the present invention is one for spraying foamable liquid in the foamed state and comprises (a) a discharge nozzle, (b) a swirling passage disposed at an upstream side of the discharge nozzle to communicate with the discharge nozzle for swirling the liquid, (c) a gas-liquid mixing passage concentrically disposed at a downstream side of the discharge nozzle to communicate with the discharge nozzle, (d) an air inlet for allowing air to enter into the gas-liquid mixing passage, and (e) a collision plate having a collision portion and a flow opening and disposed at a downstream side of the gas-liquid mixing passage to face the discharge nozzle, the collision plate being allowed to get away from a position in front of the discharge nozzle.

The liquid becomes swirling flow after passing through the swirling passage and is discharged from the discharge nozzle to the gas-liquid mixing passage. At this point, the liquid is scattered into sprayed fine particles by the centrifugal force. A negative pressure develops around the discharge nozzle by the discharge of the liquid from the discharge nozzle, thereby entering air from the air inlet to the gas-liquid mixing passage.

When the collision plate is disposed to face the discharge nozzle, part of the sprayed particles sprayed in the gas-liquid mixing passage are scattered by colliding with the gas-liquid mixing passage and the collision portion of the collision plate, and stir the flow in the gas-liquid mixing passage. As a result, the sprayed particles of the liquid and the air are mixed well in the gas-liquid mixing passage and thus become foam. The foam is mixed with the sprayed particles reached without colliding with the collision portion and discharged from the flow outlet. As mentioned above, in case of closing the collision plate, the liquid detergent is well foamed because the flow in the gas-liquid mixing passage is well stirred.

On the other hand, in the case of moving the collision plate away from a position in front of the discharge nozzle, the effect of stirring in the gas-liquid mixing passage is weak and foaming is poor because the portion where the sprayed particles sprayed in the gas-liquid mixing passage may collide with is only the inner surface of the gas-liquid mixing passage.

The opened end of the air inlet is preferably disposed near the discharge nozzle because of the mixing effectiveness between the liquid and the air.

A sprayer of the fourth aspect of the present invention, based on the third aspect, may comprise a front end member having the discharge nozzle, the swirling passage, the gas-liquid gas-liquid mixing passage, and the air inlet, the collision plate being pivotably mounted to the front end member.

In a sprayer of the fifth aspect of the present invention, based on the third aspect, the collision plate may comprise an extending passage for substantially extending the gas-liquid mixing passage in case of disposing the collision plate to face the discharge nozzle, and the collision portion and the flow opening are disposed at a downstream side of the extending passage. It should be noted that the collision plate in the third aspect may not have the extending passage.

In a sprayer of the sixth aspect of the present invention, based on the third aspect, the collision portion of the collision plate may comprise a plurality of bar-like collision walls extending toward a point on an extension of the center of the discharge nozzle, and the flow opening is disposed among the bar-like collision walls and on the extension of the center of the discharge nozzle. It should be noted that the collision portion and the flow opening in the third aspect may have structures other than those mentioned above.

A sprayer of the seventh aspect of the present invention comprises (a) a spraying member having a spraying outlet at a front end thereof, (b) a nozzle cover disposed to a front portion of the spraying member, a base portion of which is pivotably mounted to the spraying member so that the nozzle cover can be opened and closed, the nozzle cover covering the spraying outlet of the spraying member when it is in the closed state, and getting away from a position in front of the spraying outlet when it is in the opened state, (c) a first holding means for holding the nozzle cover in the closed state, and (d) a second holding means for holding the nozzle cover in the opened state.

In this sprayer, when the spraying is not needed, the spraying outlet can be held in the closed state by making the nozzle cover in the closed state and operating the first holding means. When the spraying is needed, the spraying outlet can be held in the opened state for spraying by releasing the first holding means, pivoting the nozzle cover to be opened, and then operating the second holding means. When the second holding means 260 is operated, there is no possibility of inadvertently pivoting the nozzle cover 240 downward thereby preventing the nozzle cover from blocking the spraying. Therefore, the sprayed particles are not scattered in unexpected directions due to collision with the nozzle cover.

A sprayer of the eighth aspect of the present invention is an embodiment of the third aspect and comprises (a) a spraying member having a spraying outlet at the center of the front thereof, a pair of bearings disposed on right and left sides at the upper front thereof, and a cutout formed at the lower front thereof, (b) a nozzle cover disposed to a front portion of the spraying member, the nozzle cover having a base portion pivotably mounted to the bearings of the spraying member so that the nozzle cover can be opened and closed, an engaging end disposed to a tip end portion thereof which is engageable and detachable to the cutout of the spraying member, a thin and flexible hinge portion disposed between the base portion and the tip end portion, the nozzle cover covering the spraying outlet of the spraying member when it is in the closed state, and getting away from a position in front of the spraying outlet when it is in the opened state, (c) a first holding means comprising an engaging protrusion and an engaging hole which are engageable each other and disposed on the cutout of the spraying member and the engaging end of the nozzle cover, respectively, for holding the nozzle cover in the closed state upon engagement thereof, and (d) a second holding means comprising a hook disposed on an outer surface of the engaging end of the nozzle cover and an engaging concavity disposed on a top surface of the spraying member which is engageable to the hook, for holding the nozzle cover in the opened state upon engagement thereof.

The first holding means may be structured by forming engaging protrusions on the cutout of the spraying member and forming engaging holes in the engaging end of the nozzle cover, or may be structured by forming the engaging holes in the cutout of the spraying member and forming the engaging protrusions the engaging end-of the nozzle cover. The structure of the first holding means may be the same as mentioned above in any of sprayers of the ninth aspect through the twelveth aspect described below.

A sprayer of the ninth aspect of the present invention is an embodiment of the third aspect and comprises (a) a spraying member having a spraying outlet at the center of the front thereof, a pair of bearings disposed on right and left sides at the upper front thereof, and a cutout formed at the lower front thereof, (b) a nozzle cover disposed to a front portion of the spraying member, the nozzle cover having a base portion pivotably mounted to the bearings of the spraying member so that the nozzle cover can be opened and closed, and an engaging end disposed to a tip end portion thereof which is engageable and detachable to the cutout of the spraying member, the nozzle cover covering the spraying outlet of the spraying member when it is in the closed state, and getting away from a position in front of the spraying outlet when it is in the opened state, (c) a first holding means comprising an engaging protrusion and an engaging hole which are engageable each other and disposed on the cutout of the spraying member and the engaging end of the nozzle cover, respectively, for holding the nozzle cover in the closed state upon engagement thereof, and (d) a second holding means comprising an engaging protrusion disposed on an outer surface of the base portion of the nozzle cover and a front edge of the spraying member, wherein when the nozzle cover is pivoted to be opened, at the end of this pivotal movement, the engaging protrusion can pass over the front edge, for holding the nozzle cover in the opened state upon engagement of the engaging protrusion and the front edge after passing over.

A sprayer of the tenth aspect of the present invention is an embodiment of the seventh aspect and comprises (a) a spraying member having a spraying outlet at the center of the front thereof, a pair of bearings disposed on right and left sides at the upper front thereof, and a cutout formed at the lower front thereof, (b) a nozzle cover disposed to a front portion of the spraying member, the nozzle cover having a base portion pivotably mounted to the bearings of the spraying member so that the nozzle cover can be opened and closed, and an engaging end disposed to a tip end portion thereof which is engageable and detachable to the cutout of the spraying member, the nozzle cover covering the spraying outlet of the spraying member when it is in the closed state, and getting away from a position in front of the spraying outlet when it is in the opened state, (c) a first holding means comprising an engaging protrusion and an engaging hole which are engageable each other and disposed on the cutout of the spraying member and the engaging end of the nozzle cover, respectively, for holding the nozzle cover in the closed state upon engagement thereof, and (d) a second holding means comprising engaging protrusions and engaging holes which are engageable to each other and are disposed on side surfaces of the base portion of the nozzle cover and on the inner surfaces of the bearings of the spraying member, respectively, for holding the nozzle cover in the opened state upon engagement thereof.

The second holding means may be structured by forming an engaging protrusion on the nozzle cover and forming an engaging hole in the spraying member, or may be structured by forming the engaging hole in the nozzle cover and forming the engaging protrusion on the spraying member.

A sprayer of the eleventh aspect of the present invention is an embodiment of the seventh aspect and comprisis (a) a spraying member having a spraying outlet at the center of the front thereof, a pair of bearings disposed on right and left sides at the upper front thereof, and a cutout formed at the lower front thereof, (b) a nozzle cover disposed to a front portion of the spraying member, the nozzle cover having a base portion pivotably mounted to the bearings of the spraying member so that the nozzle cover can be opened and closed, and an engaging end disposed to a tip end portion thereof which is engageable and detachable to the cutout of the spraying member, the nozzle cover covering the spraying outlet of the spraying member when it is in the closed state, and getting away from a position in front of the spraying outlet when it is in the opened state, (c) a first holding means comprising an engaging protrusion and an engaging hole which are engageable each other and disposed on the cutout of the spraying member and the engaging end of the nozzle cover, respectively, for holding the nozzle cover in the closed state upon engagement thereof, and (d) a second holding means comprising step portions disposed on both sides in the middle of the nozzle cover and top surfaces of the bearings of the spraying member, wherein when the nozzle cover is pivoted to be opened, at the end of this pivotal movement, the step portions sit on the top surfaces, thereby inclining backward the nozzle cover to hold the nozzle cover in the opened state.

A sprayer of the twelveth aspect of the present invention is an embodiment of the seventh aspect and comprises (a) a spraying member having a spraying outlet at the center of the front thereof, a pair of bearings disposed on right and left sides at the upper front thereof, and a cutout formed at the lower front thereof, (b) a nozzle cover disposed to a front portion of the spraying member, the nozzle cover having a base portion pivotably mounted to the bearings of the spraying member so that the nozzle cover can be opened and closed, and an engaging end disposed to a tip end portion thereof which is engageable and detachable to the cutout of the spraying member, the nozzle cover covering the spraying outlet of the spraying member when it is in the closed state, and getting away from a position in front of the spraying outlet when it is in the opened state, (c) a first holding means comprising an engaging protrusion and an engaging hole which are engageable each other and disposed on the cutout of the spraying member and the engaging end of the nozzle cover, respectively, for holding the nozzle cover in the closed state upon engagement thereof, and (d) a second holding means comprising a hollow formed at a rear side of the bearings, wherein when the nozzle cover is pivoted to be opened, at the end of this pivotal movement, the nozzle cover tilts rearwardly so that part of the nozzle cover is inserted into the hollow, thereby holding the nozzle cover in the opened state.

It should be noted that a trigger or other type of mechanism for driving the pump may be employed in any of the sprayers of the first aspect through the twelveth aspect.

DETAILED DESCRIPTION OF THE PREFERRED EMBODIMENTS

Hereinafter, preferred embodiments of the present invention will be described with reference to the attached drawings.

EXAMPLE 1

A sprayer according to Example 1 will be described based on FIG. 1 through FIG. 6.

Figure 1:
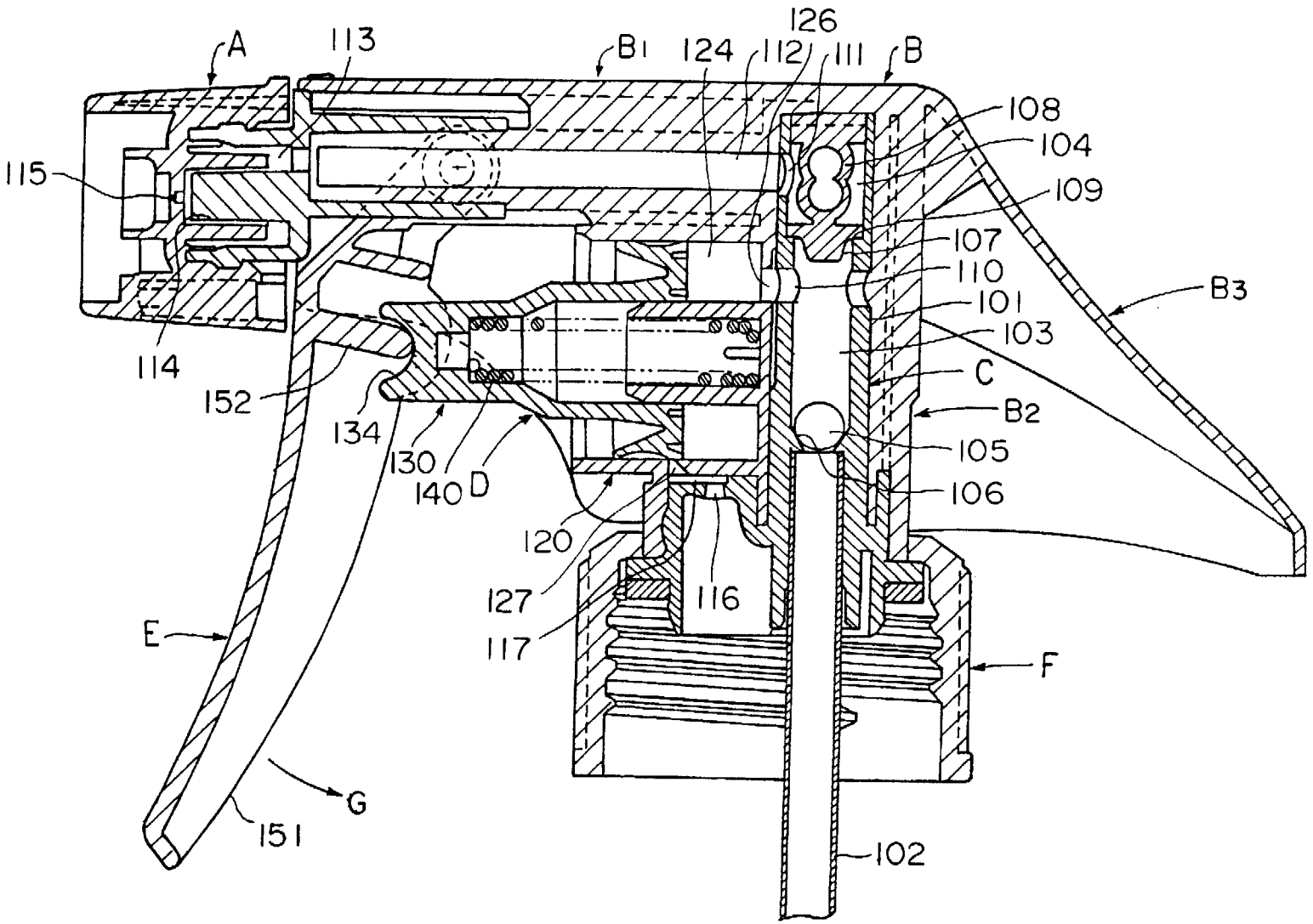
FIG. 1 is a vertical sectional view of a sprayer according to Example 1.

The sprayer of this example is of a trigger type and is mounted to the neck of a container (not shown) for use. FIG. 1 is a vertical sectional view of the sprayer which comprises a sprayer body B having an injector cylinder $B_1$, a supporting cylinder $B_2$, and a grip portion $B_3$, a spraying member A disposed on the front end of the sprayer body B, a discharge chamber C, a pump chamber D, a trigger E, and a mounting cap F.

The mounting cap F is attached to the lower end of the supporting cylinder $B_2$. The sprayer is fixed to the neck of the container by the mounting cap F.

The discharge chamber C comprises a discharge cylinder 101 mounted in the supporting cylinder B2. The discharge cylinder 101 is provided with a suction chamber 103 at the lower side thereof and a discharge valve chamber 104 at the upper side thereof. The lower end of the discharge cylinder 101 is connected to a suction pipe 102 whereby the suction chamber 103 communicates with the inside of the container.

A valve seat 106 is formed on the inner wall of the suction chamber 103 and just above the suction pipe 102, and a valve ball 105 contained in the suction chamber 103 can sit on or move apart from the valve seat 106.

In the discharge valve chamber 104, a discharge valve 107, which has an elastic deformable portion 108 engaging the upper end of the discharge valve chamber 104, is contained. The discharge valve 107 can sit on or move apart from a valve seat 109 disposed between the suction chamber 103 and the discharge valve chamber 104.

The discharge cylinder 101 is provided with an opening 110 allowing the suction chamber 103 to communicate with a cylinder chamber 124 described later, and an opening 111 allowing the discharge valve chamber 104 to communicate with a discharge passage 112 described later.

The injector cylinder $B_1$ is provided with the discharge passage 112 communicating with the discharge valve chamber 104 through the opening 111. The spraying member A is provided with passages 113, 114 communicating with the discharge passage 112, and a spraying outlet 115 communicating with the passage 114.

Figure 2:
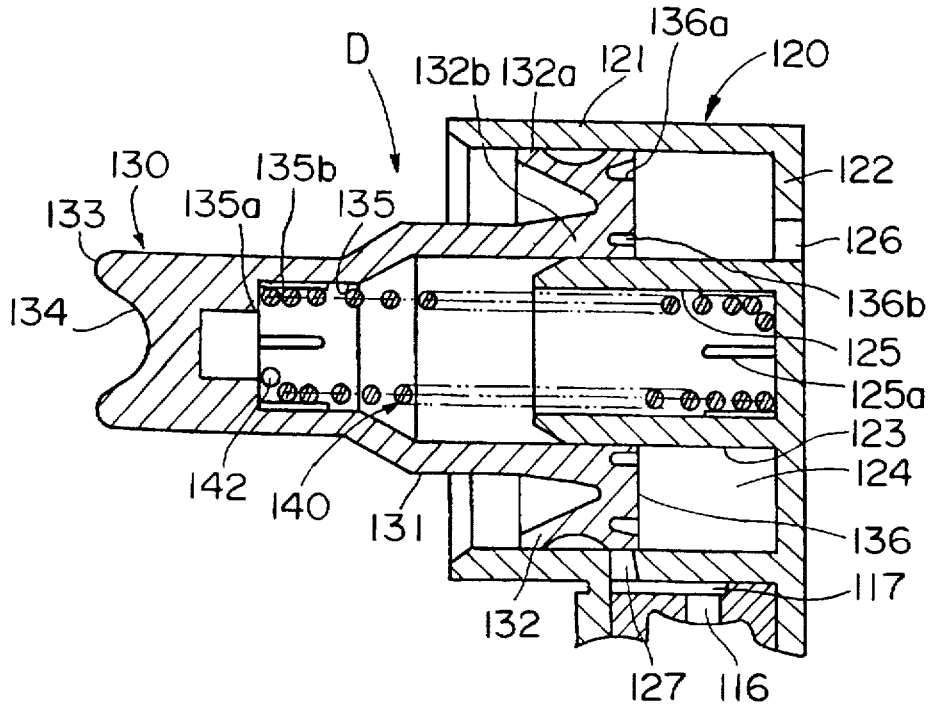
FIG. 2 is a vertical sectional view of a pump chamber used in the sprayer according to Example 1.

The pump chamber D comprises a cylinder 120 and a piston 130. FIG. 2 is an enlarged sectional view of the pump chamber D. The cylinder 120 is provided with an outer cylinder 121, a bottom wall 122, and an inner cylinder 123 so that a cylinder chamber 124 is formed between the inner surface of the cylinder 120 and an end face 136 of the piston 130.

In the inner cylinder 123, it is provided a supporting hole 125 for holding a coil spring 140 described later therein, and a plurality of projections **125*a* for supporting the coil spring 140** disposed on the inner surface thereof.

The bottom wall 122 of the cylinder 120 is provided with an opening 126 communicating with the suction chamber 103 through the opening 110. The outer cylinder 121 is provided, at the lower side thereof, with an air inlet 127 allowing the inside of the container to communicate with the atmosphere at the end of the forward motion of the piston 130. In this specification, the expression "the foward motion of the piston 130" means that the piston 130 moves in the direction approaching the bottom wall 122 of the cylinder 120. The air inlet 127 communicates through the passage 117 with an opening 116 disposed in the discharge cylinder 101 at the lower side thereof, and further communicates with the container through the opening 116.

The piston 130 is provided with a cylindrical portion 131 and a piston portion 132. The cylindrical portion 131 has a concavity 134 formed in an end 133 thereof for engaging with a trigger E, and a supporting hole 135 formed therein for supporting the coil spring 140. The supporting hole 135 has a step **135*a* and a plurality of projections 135*b* for holding the coil spring 140** which are disposed on the inner surface thereof.

The piston portion 132 is made of an elastic material and comprises an outer slider 132*a* air-tightly sliding on the inner surface of the outer cylinder 121 of the cylinder 120, an inner slider 132*b* air-tightly sliding on the outer surface of the inner cylinder 123 of the cylinder 120, and the end face 136 facing to the cylinder chamber 124.

The outer slider 132*a* is formed in an arch-like configuration and has diameters of the both ends thereof are set to be slightly larger than the inner diameter of the outer cylinder 121 of the cylinder 120. This is because the air-tightness of the cylinder 120 must be kept when the piston 130 is inserted into the cylinder 120. The end face 136 of the piston 130 is provided with annular grooves 136*a*, 136*b* formed therein for absorbing the deformation when the piston 130 is inserted into the cylinder 120.

The trigger E has a handle member 151, which is pivotably mounted to the injector cylinder $B_1$ at one end thereof, and a pushing piece 152 disposed on the handle member 151. The pushing piece 152 engages with the concavity 134 of the piston 130.

The coil spring 140 for elastically returning the trigger E is mounted between the cylindrical portion 131 of the piston 130 and the inner cylinder 123 of the cylinder 120.

Figure 3:
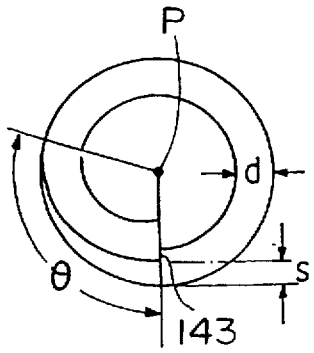
FIG. 3 is a front view of a coil spring used in the sprayer according to Example 1.
Figure 4:
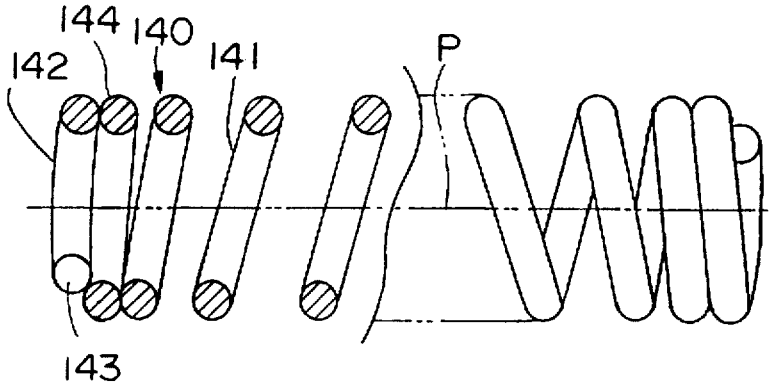
FIG. 4 is a side view, partly sectioned, of the coil spring of the sprayer according to Example 1.

The coil spring 140 in this example is described with reference to FIG. 3 and FIG. 4. FIG. 3 is a front view of the coil spring 140 and FIG. 4 is a partially sectioned side view of it.

The coil spring 140 comprises a coil wire 141 and is formed so that both wire end portions 142 of the coil wire 141 are in contact with the adjacent coil wire portions 144, respectively and are inwardly deflected, and a portion of each wire end portion 142 which extends in a predetermined length from each end 143 of the coil wire 141 is positioned on a plane perpendicular or nearly perpendicular to the axis P of the coil spring 140.

While the deflected portion of the wire end portion 142 is preferably positioned on a plane perpendicular to the axis, it is not necessary that the deflected portion is positioned precisely on a plane perpendicular to the axis, that is, the deflected portion may be positioned nearly perpendicular to the axis.

FIG. 3 shows a case where a portion which extends from the end 143 to have an angle e (hereinafter, referred to as the deflection angle 6) about the axis P of the coil spring 140 is positioned on a plane perpendicular or nearly perpendicular to the axis P of the coil spring 140, and the end 143 is deflected from the circumscribed circle of the coil wire 141 by a length s (hereinafter, referred to as the deflection length s).

There is a relation among the wire diameter of the coil wire 141, the deflection length s, and the deflection angle θ. For example, when the deflection angle θ is 90°, the deflection length s is approximately 0.66d.

Figure 5:
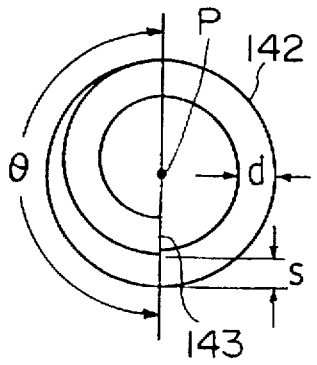
FIG. 5 is a front view of a modified example of the coil spring the sprayer according to Example 1.
Figure 6:
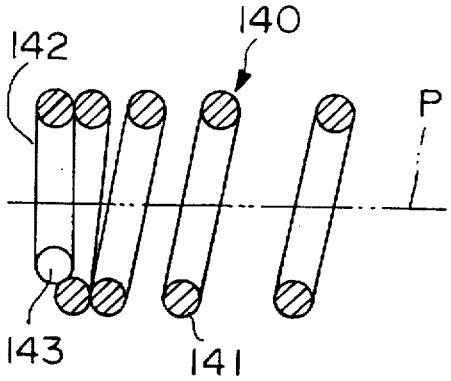
FIG. 6 is a vertical sectional side view of the modified example of the coil spring of the sprayer according to Example 1.

As shown in FIG. 5 and FIG. 6, when the deflection angle θ is 180°, the deflection length s is approximately 0.87d.

The coil spring 140 as structured above is quite advantageous for assembling the pump chamber D. Now, the description will be made as regard to this.

For assembling the pump chamber D, one end of the coil spring 140 is inserted into the supporting hole 135 of the piston 130 and the wire end portion 142 of the coil spring 140 is engaged with the step 135*a*. Since the wire end portion 142 is positioned on a plane nearly perpendicular to the axis P of the coil spring 140, the axis P of the coil spring 140 becomes substantially the same as the axis of the piston 130 by engaging the wire end portion 142 with the step 135*a*.

Then, the piston 130 to which the coil spring 140 is mounted is mounted to the cylinder 120. At this point, the other end side of the coil spring 140 must be inserted to the supporting hole 125 of the cylinder 120 at the same time that the piston 130 is inserted to the cylinder 120.

In a case of this sprayer, the axis P of the coil spring 140 is substantially the same as the axis of the piston 130 as mentioned above, whereby the insertion of the piston 130 to the cylinder 120 and the insertion of the other end side of the coil spring 140 into the supporting hole 125 can be smoothly and securely achieved at the same time. Therefore, it can prevent the incomplete installation of the coil spring.

In addition, when the other end side of the coil spring 140 is inserted to the supporting hole 125 of the cylinder 120, there is no chance to scratch the inner surface of the supporting hole 125. As a result, there is also no chance to disturb the smooth expansion and contraction of the coil spring 140.

As described above, for making the assembly of the pump chamber D easy, the lager deflection angle θ of the wire end portion 142 of the coil spring 140 is better. Practically, the advantage as mentioned above can be obtained upon setting it to satisfy the formula: $s \geqq 0.5d$.

Hereinafter, the description will be made as regard to the operation of this sprayer. Upon pushing the trigger E of the sprayer fixed to the neck of the container in the direction of the arrow G, the pushing piece 152 pushes the concavity 134 of the front end 133 of the piston 130. As a result of this, the end face 136 of the piston portion 132 moves until coming in contact with the bottom wall 122 of the cylinder 120 so as to push out the liquid filling the cylinder chamber 124 from the opening 126 to the suction chamber 103. Then the discharge valve 107 is pushed upwardly by the hydraulic pressure in the suction chamber 103.

The discharge valve 107 rises from the valve seat 109 according to the elastic deformation of the elastic deformable portion 108 to open valve. As a result, the liquid is entered from the suction chamber 103 into the discharge valve chamber 104 and further into the discharge passage 112 through the opening 111. Furthermore, through the passages 113, 114, the liquid is atomized from the spray output 115.

During this process, the cylindrical portion 131 of the piston 130 compresses the coil spring 140 and the valve ball 105 is seated on the valve seat 106 by the hydraulic pressure in the suction chamber 103 to close valve.

Upon completion of the spraying of the liquid from the spraying outlet 115, by releasing the trigger E from being pressed, the piston 130 is returned to the position shown in FIG. 1 by the elastic force of the coil spring 140. As a result, the cylinder chamber 124 becomes larger so that a negative pressure develops in the cylinder chamber 124. The negative pressure effects the discharge valve 107 and valve ball 105. That is, the negative pressure seats the discharge valve 107 on the valve seat 109 to close the valve and makes the valve ball 105 separate from the valve seat 106 to open the valve. As a result of this, the liquid in the container is sucked up to the suction chamber 103 through the suction pipe 102 and, further, charged into the cylinder chamber 124 through the openings 110, 126 in preparation for the next spraying.

The air inlet 127 formed in the outer cylinder 121 of the cylinder 120 communicates with the atmosphere to introduce the atmosphere into the container through the passage 117 and the opening 116 when the end face 136 of the piston 130 approaches to the bottom wall 122 of the cylinder 120. After that, the air inlet 127 is designed to be closed by the outer slider 132*a* of the piston 130 when the piston 130 is returned to the position shown in FIG. 1 thereby preventing the liquid in the container from spilling out from the air inlet 127 even when the container is toppled.

Though the axis of the pump chamber D is arranged parallel to that of the injector cylinder $B_1$ in this example, the coil spring 140 as structured above may be used in a sprayer in which the axis of the pump chamber D is arranged to intersect the axis of the injector cylinder $B_1$ as disclosed in Japanese Utility Model Publication No. 62-770 (1987).

EXAMPLE 2

A sprayer according to Example 2 will be described with reference to FIG. 7 through FIG. 24.

Figure 9:
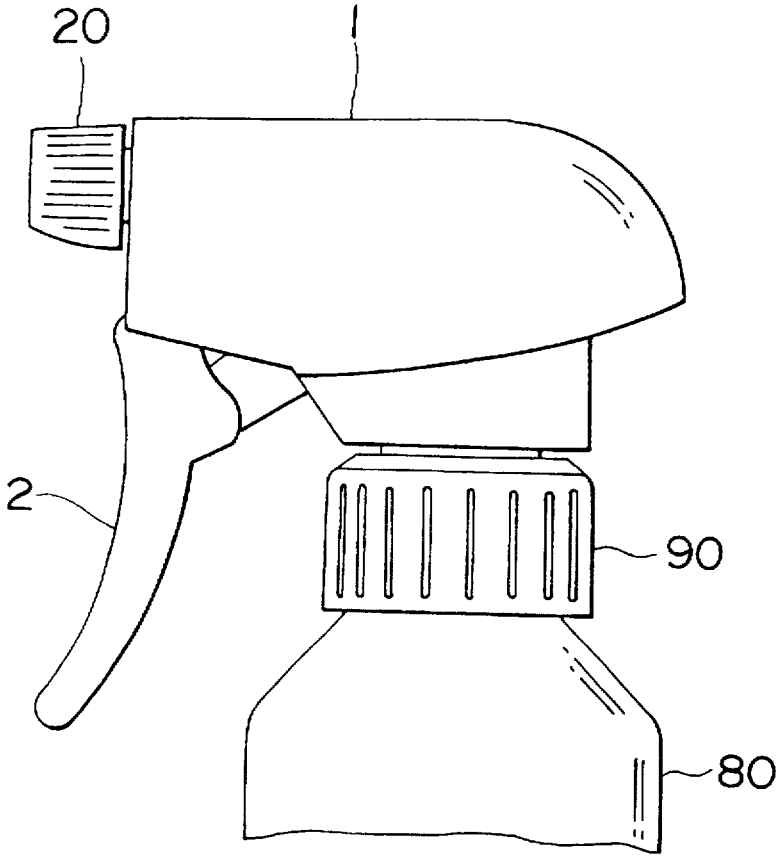
FIG. 9 is a side view showing the sprayer of Example 2 when it is mounted to a container.

FIG. 9 is a side view of the outside of the sprayer, which is fixed to the neck of a container 80 filled with liquid detergent (foamable liquid), through a cap 90.

The sprayer is of a trigger-type and comprises a frame 1, a trigger 2 energized forward by a spring (not shown), a spraying member 20 mounted to the front end of the frame 1. In this sprayer, when the trigger 2 is forward returned by the elastic force of the spring, the liquid detergent in the container 80 is pumped up into the frame 1 and, when the trigger 2 is pulled rearwardly, the liquid detergent pumped up in the frame 2 is sprayed in a foam state from the front end of the spraying member 20.

Figure 7:
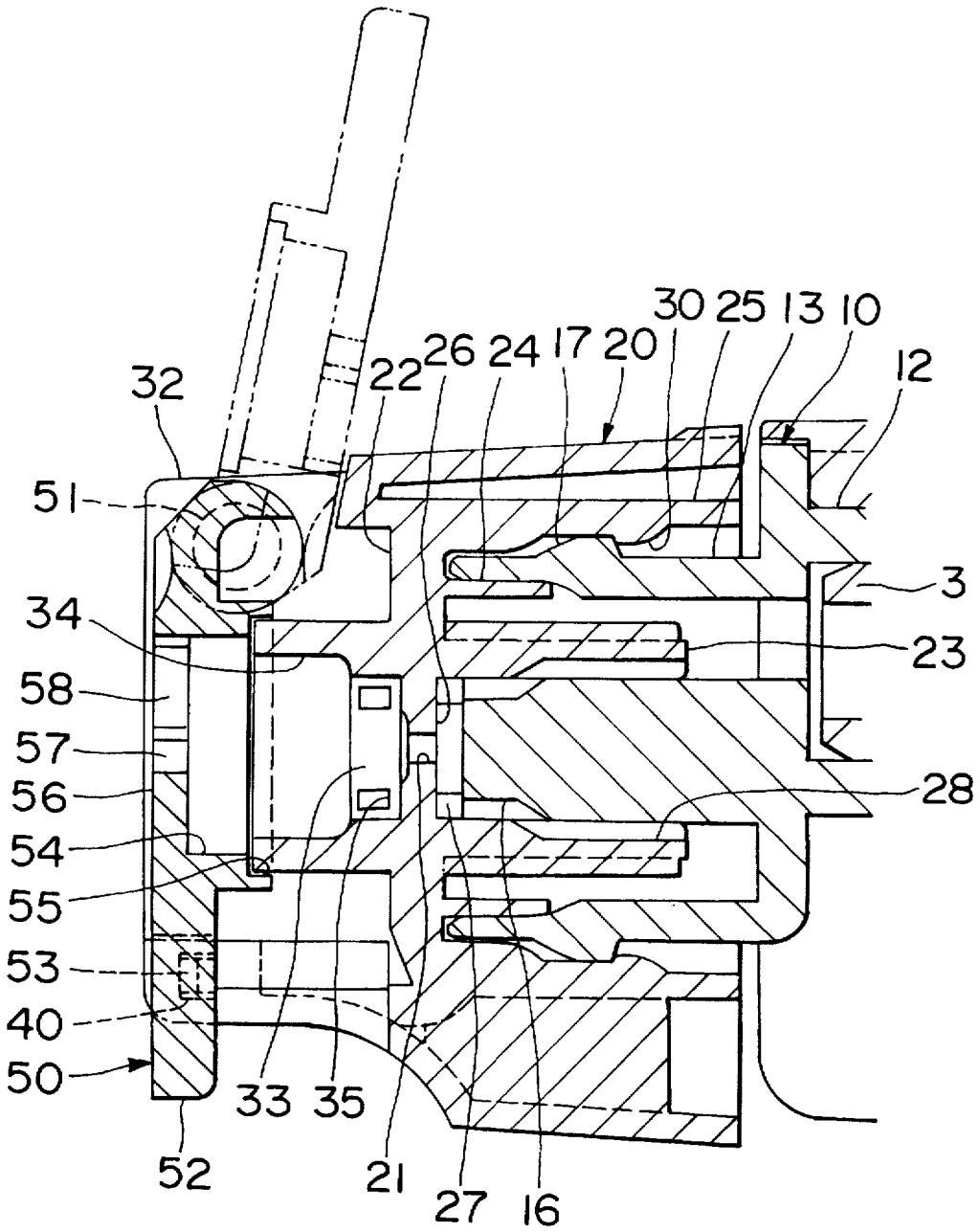
FIG. 7 is a vertical sectional view of a discharge portion of a sprayer according to Example 2, in its assembled state (taken along a line I—I of FIG. 8)
Figure 8:
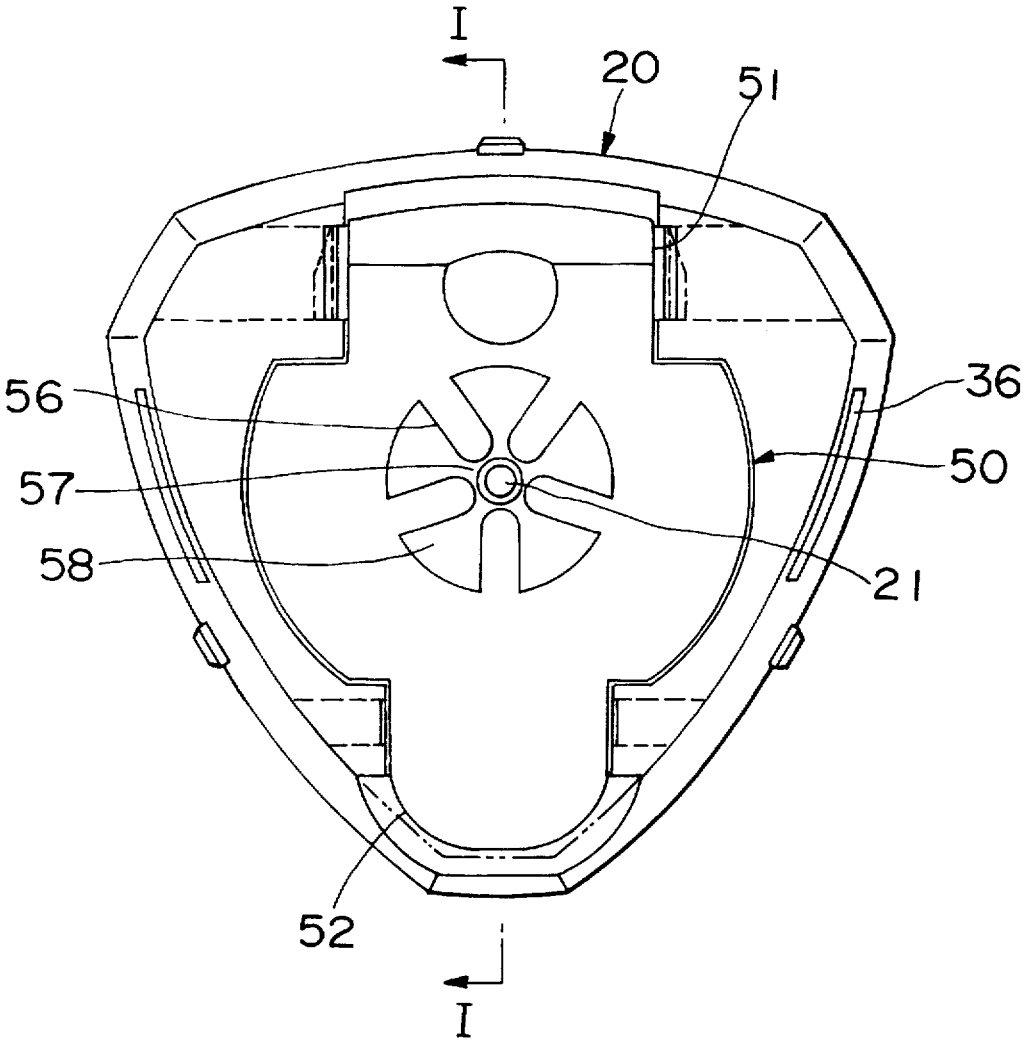
FIG. 8 is a front view of the discharge portion of the sprayer according to Example 2, in its assembled state.

FIG. 7 is a vertical sectional view of a discharge portion of the sprayer (taken along the line I—I of FIG. 8), and FIG. 8 is a front view of the same.

The frame 1 is provided with a discharge tube 3 at the front end portion thereof, to which a supporting member 10 is fixed.

Figure 10:
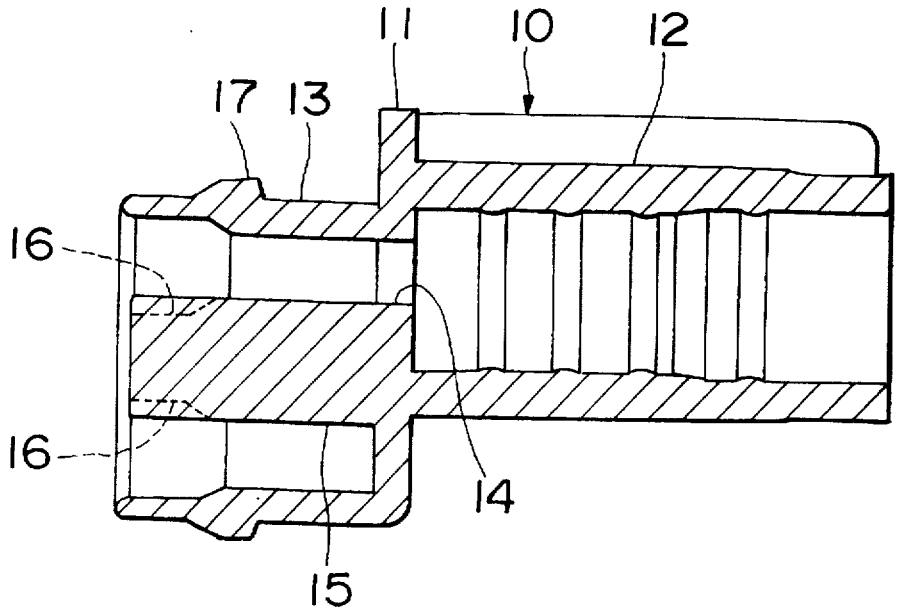
FIG. 10 is a vertical sectional view of a supporting member used in the sprayer according to Example 2 (taken along a line II—II of FIG. 11)
Figure 11:
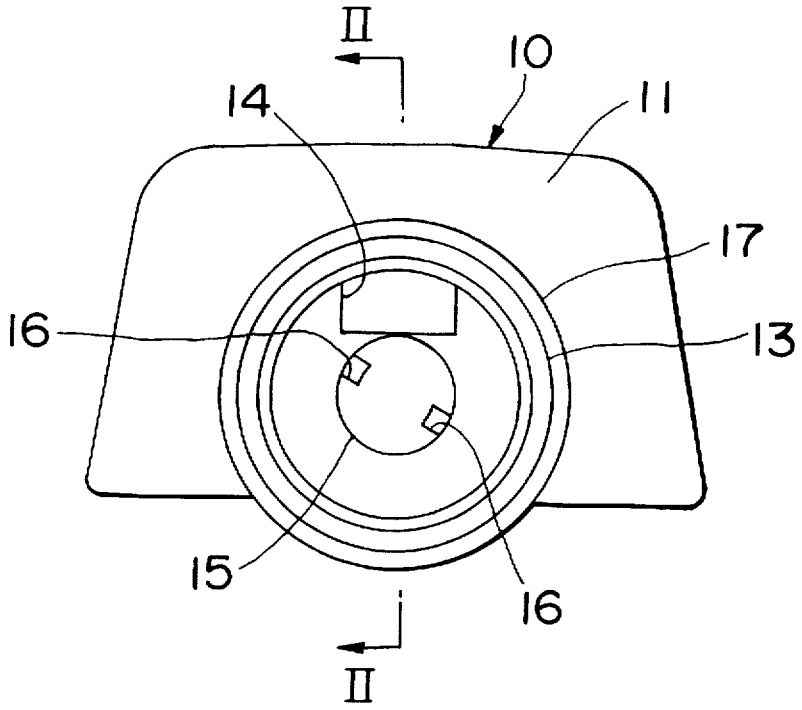
FIG. 11 is a front view of the supporting member of the sprayer according to Example 2.

FIG. 10 is a vertical sectional view of the supporting member 10 (taken along the line II—II of FIG. 11), and FIG. 11 is a front view of the same. The supporting member 10 has a base cylinder 12, a holding cylinder 13, and a partition 11 disposed between the base cylinder 12 and the holding cylinder 13 which are eccentric to each other. The base cylinder 12 is sealingly fixed to the outside of the discharge tube 3.

The base cylinder 12 and the holding cylinder 13 communicate with each other through a through hole 14 formed in the partition 11. A column-like shaft member 15 which is concentrically disposed inside the holding cylinder 13 projects from the partition 11. The shaft member 15 is provided with two vertical grooves 16, 16 which are formed in a front-side outer surface thereof, extend to the front end face of the shaft member 15 in the longitudinal direction thereof, and are spaced apart from each other by 180° with respect to the circumferential direction.

Figure 12:
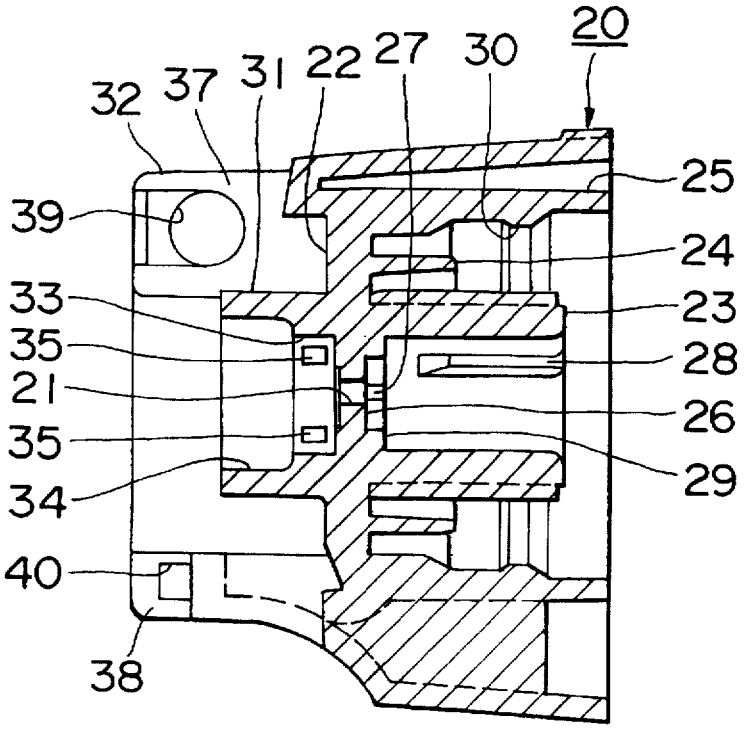
FIG. 12 is a vertical sectional view of a spraying member used in the sprayer according to Example 2 (taken along a line III—III of FIG. 13)
Figure 13:
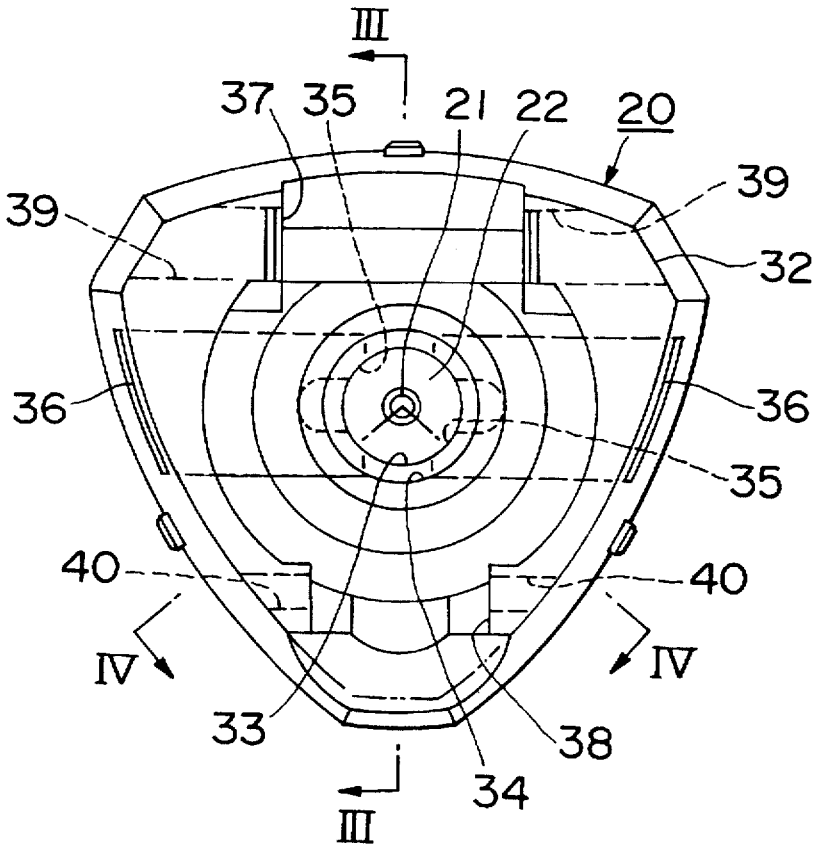
FIG. 13 is a front view of the spraying member of the sprayer according to Example 2.
Figure 14:
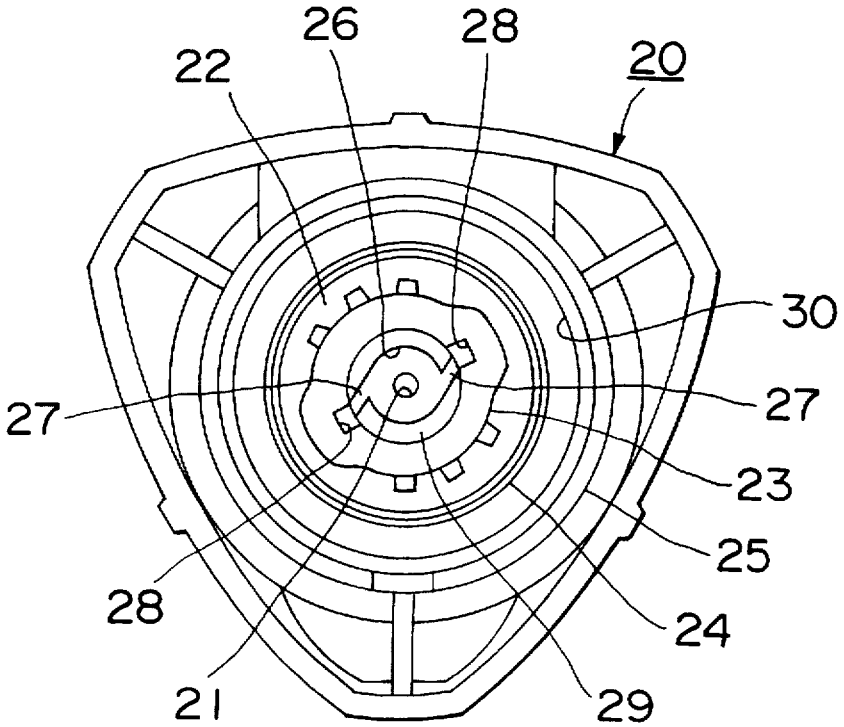
FIG. 14 is a rear view of the spraying member of the sprayer according to Example 2.
Figure 15:
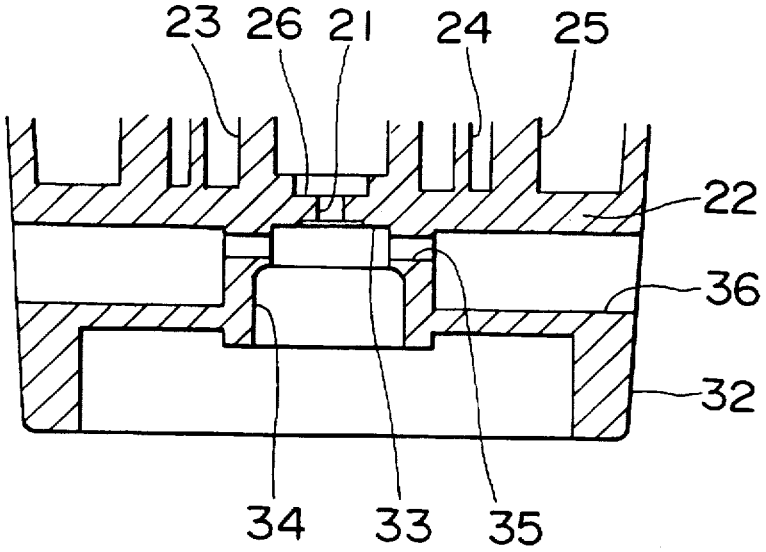
FIG. 15 is a sectional view taken along a line IV—IV of FIG. 13.

The spraying member 20 is mounted to the holding cylinder 13 of the supporting member 10. FIG. 12 is a vertical sectional view of the spraying member 20 (taken along the line III—III of FIG. 13), FIG. 13 is a front view of the same, FIG. 14 is a rear view of the same, and FIG. 15 is a sectional view taken along the line IV—IV of FIG. 13.

The spraying member 20 has a vertical wall 22 through which a discharge nozzle 21 is formed in the center thereof. An inner cylinder 23, a middle cylinder 24, and an outer cylinder 25 each of which is formed in an annulus-ring shape, project rearwardly from the vertical wall 22 in a concentric arrangement with the discharge nozzle 21.

The bottom face 29 of the inner cylinder 23 is provided with a round small-diameter concavity 26 which is concentric with the discharge nozzle 21, and two grooves (swirling passages) 27, 27 which oppositely extend from the small concavity 26 to the outside in the tangential direction of the inner circumference of the small-diameter concavity 26. The inner surface of the inner cylinder 23 has two vertical grooves 28, 28 at the top side thereof, which linearly extend from the top end to a position in front of the bottom face 29 of the inner cylinder 23 and are spaced apart from each other by 180° with respect to the circumferential direction. The grooves 27, 27 lie on the extensions of the vertical grooves 28, 28, respectively.

The spraying member 20 is mounted to the supporting member 10 to allow it to be rotated and not to allow it to be removed by closely, rotatablely inserting the shaft member 15 of the supporting member 10 into the inner cylinder 23, closely, rotatably inserting the outer surface of the middle cylinder 24 into the front-side inner surface of the holding cylinder 13 of the supporting member 10, and engaging an engaging ring 30 disposed on the inner surface of the outer cylinder 25 with the engaging ring 17 disposed on the outer surface of the holding cylinder 13. The end face of the shaft member 15 of the supporting member 10 comes in contact with the bottom face 29 of the inner cylinder 23 to close the small-diameter concavity 26.

The rotation of the spraying member 20 relative to the supporting member 10 can make the rear ends of the vertical grooves 16 of the supporting member 10 coincide with and come out of the front ends of the vertical grooves 28 of the spraying member 20, respectively.

FIG. 7 shows a state in which the rear ends of the vertical grooves 16 coincide with the front ends of the vertical grooves 28, respectively. In this state, the grooves 27 communicate with the vertical grooves 28 through the vertical grooves 16. When the vertical grooves 16 and 28 are positioned not to coincide with each other, the vertical grooves 28 are closed with the outer surface of the shaft member 15 and the vertical grooves 16 are closed with the inner surface of the inner cylinder 23, thereby shutting off the communication between the vertical grooves 16 and vertical grooves 28.

From the vertical wall 22 of the spraying member 20, a hollow projection 31 and the shell-like wall 32 project forward. In the inside of the projection 31, a round small-diameter concavity 33 communicating with the discharge nozzle 21 and a round large-diameter concavity 34 are formed in a concentric arragement with the discharge nozzle 21. The shell-like wall 32 is disposed outside the projection 31 and the front end of the shell-like wall 32 projects forward more than the projection 31.

On the inner surface of the small-diameter concavity 33, four air holes (air inlets) 35 are formed, each of which communicates with one of air passages 36 opened in the outer surface of the shell-like wall 32. The shell-like wall 32 has cutouts 37, 38 in the upper and lower sides, respectively, and also has through holes 39, 39 formed at the both sides of the upper cutout 37 and through holes 40, 40 formed at the both sides of the lower cutout 38.

Figure 16:
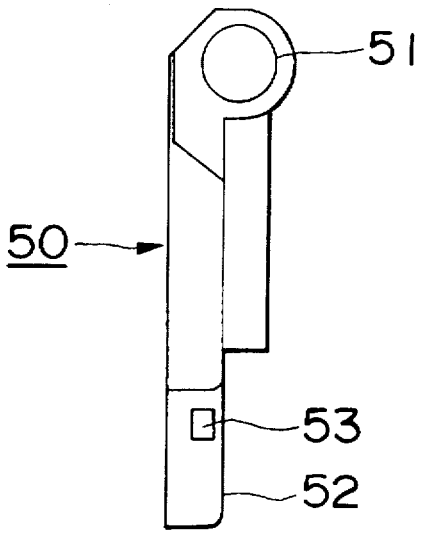
FIG. 16 is a side view of a collision plate used in the sprayer according to Example 2.
Figure 17:
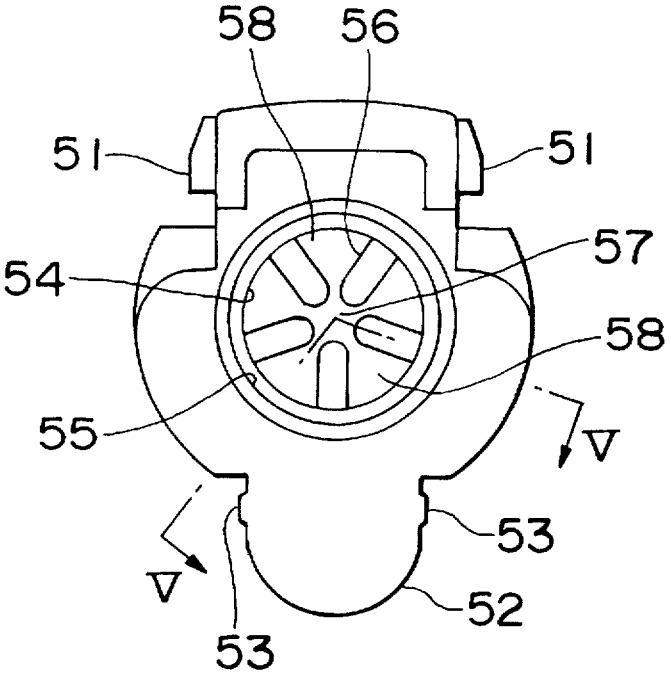
FIG. 17 is a rear view of the collision plate of the sprayer according to Example 2.
Figure 18:
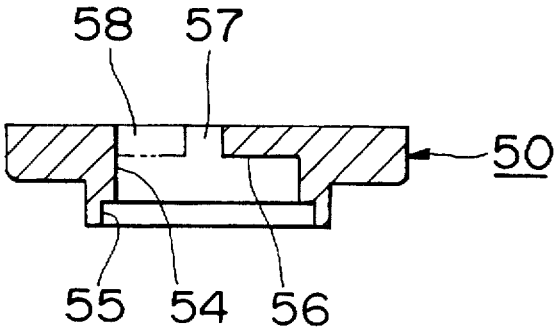
FIG. 18 is a sectional view taken along a line V—V of FIG. 17.

A collision plate 50 is mounted to the front end of the spraying member 20. FIG. 16 is a side view of the collision plate 50, FIG. 17 is a rear view of the same (from the right side of the FIG. 16), and FIG. 18 is a sectional view taken along the line V—V of FIG. 17.

The collision plate 50 is provided with a pair of supporting shaft portions 51, 51 on the upper side thereof. By inserting the supporting shaft portions 51, 51 into the through holes 39, 39 of the spraying member 20, respectively, the collision plate 50 is pivotably supported. It should be noted that the supporting shaft portions 51 are tightly fitted into the through hole 39, thereby preventing the collision plate 50 from inadvertently pivoting.

The collision plate 50 is designed to have a configuration and a size to be fit inside the shell-like wall 32 of the spraying member 20 when the collision plate 50 is suspended as shown in FIG. 7 and FIG. 8 (hereinafter, referred to as the closed state of the collision plate 50). The collision plate 50 has a tongue 52 disposed on the lower side thereof to extend lower than the shell wall 32. Engaging protrusions 53, 53 provided on the both sides of the tongue 52 engage the through holes 40, 40 of the shell-like wall 32, respectively, whereby the collision plate 50 can be locked in the closed state.

The collision plate 50 has a through hole (extending passage) 54 which is concentric with the discharge nozzle 21 when the collision plate 50 is in the closed state. The through hole 54 has an inner diameter slightly larger than the inner diameter of the large-diameter concavity 34 of the spraying member 20. The through hole 54 is provided with a step hole 55 having a inner diameter larger than that of the through hole 54, at the rear side thereof. In the closed state of the collision plate 50, the front end of the projection 31 of the spraying member 20 is in the step hole 55 so that it is positioned closely to the stepped portion.

The collision plate 50 has five bar-like collision walls (collision wall portions) 56 extending from the inner surface of the through hole 54 toward the center of the through hole 54, at the front end side at even intervals. The tips of the bar-like collision walls 56 are spaced from each other. The front end of the though hole 54 is divided into a center opening (flow opening) 57 and five fan-shaped openings (flow opening) 58 positioned around the center opening 57 by the five bar-like collision walls.

The description will now be made as regard to the operation of the sprayer. By rotating the spraying member 20 to bring the vertical groove 16 of the supporting member 10 to communicate with the vertical groove 28 of the spraying member 20, and pulling the trigger 2 rearwardly, the liquid detergent in the container 80 is pumped up to the discharge tube 3. The liquid detergent passes through the base cylinder 12, the through hole 14, and the holding cylinder 13 of the supporting member 10 and then entered into the small-diameter concavity 26 through the vertical grooves 16, 28 and grooves 27.

The liquid detergent becomes high-speed swirling flow when it is entered into the small-diameter concavity 26 from the grooves 27 and flows through the discharge nozzle 21 while swirling at a high speed. The liquid detergent from the discharge nozzle 21 is discharged to the small-diameter concavity 33 and the large-diameter concavity 34 while it is scattered into small particles by centrifugal force. As the liquid detergent is discharged from the discharge nozzle 21, a negative pressure develops in the small-diameter concavity 33 whereby air is entered into the small-diameter concavity 33 through the air hole 35.

In this sprayer, the spray state of the sprayed liquid detergent can be suitably selected by opening or closing the collision plate 50. Hereinafter, the description will be made as regard to this.

<In Case of Closing the Collision Plate 50>

Figure 19:
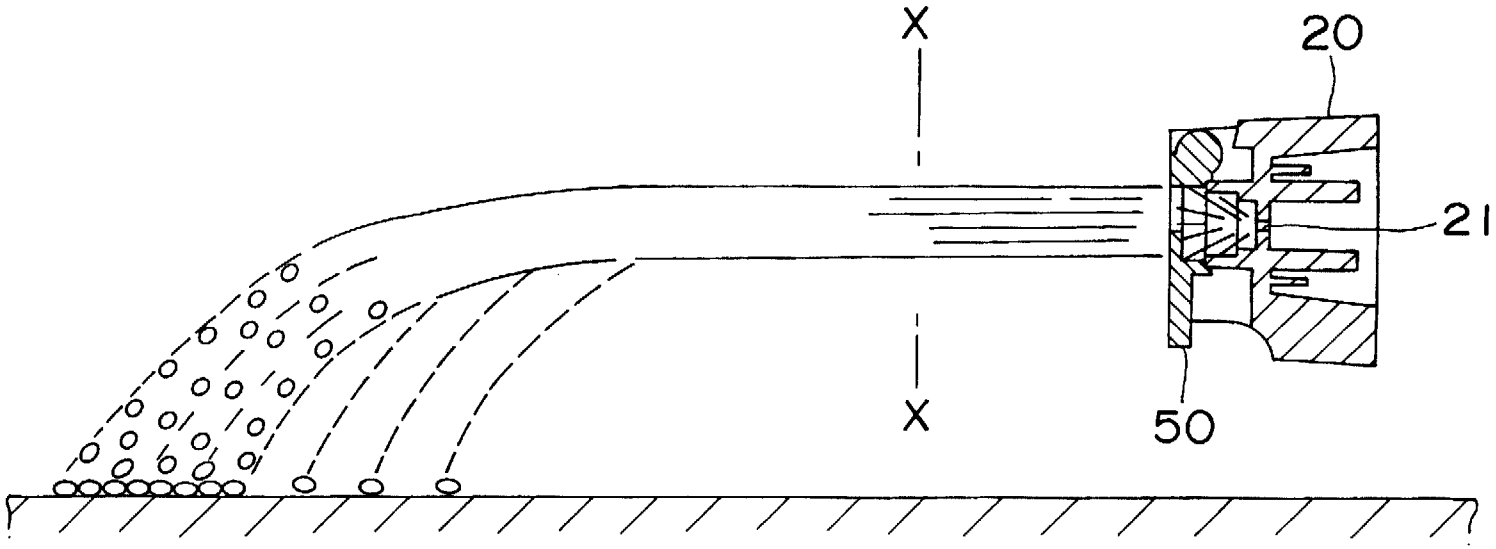
FIG. 19 is a view showing a spraying state of the sprayer of Example 2 when the collision plate is disposed to face a discharge nozzle.

FIG. 19 shows a spray state of the sprayed liquid detergent when the collision plate 50 is located to face a discharge nozzle 21. In this case, the small-diameter concavity 33 and the large-diameter concavity 34 of the spraying member 20 and the through hole 54 of the collision plate 50 form together a gas-liquid mixing passage so that part of sprayed particles of the liquid detergent sprayed from the discharge nozzle 21 become smaller particles and scatter by colliding with the inner surface of the aforementioned gas-liquid mixing passage or the bar-like collision walls 56 of the collision plate 50, and stir the flow in the gas-liquid mixing passage. As a result of this, the sprayed particles of the liquid detergent are mixed with air entered from the air holes in the gas-liquid mixing passage so as to become foams. The foams are mixed with the sprayed particles directly reached without colliding with the bar-like walls 56 and the like and then discharged from the openings 57, 58 of the collision plate 50.

When the collision plate 50 is closed as mentioned above, the flow is stirred well in the gas-liquid mixing passage so that the detergent is foamed well. Since the distance between the discharge nozzle 21 and the front end of the gas-liquid mixing passage is long and the scattered angle is limited, the foams and the sprayed particles discharged from the openings 57, 58 are sprayed forward in the bundle state with little scattering.

Figure 20:
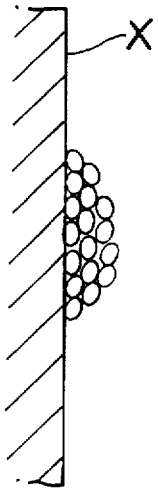
FIG. 20 is a side view showing the deposited state of foam on a wall surface which is sprayed from the sprayer of Example 2 when the collision plate is disposed to face a discharge nozzle.
Figure 21:
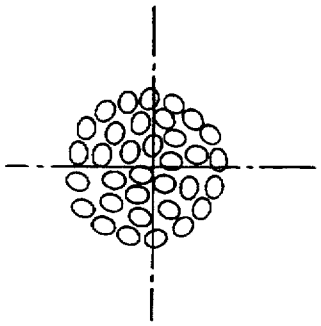
FIG. 21 is a front view showing the deposited state of the foam on the wall surface which is sprayed from the sprayer of Example 2 when the collision plate is disposed to face the discharge nozzle.

As a result of observing the deposited state of the liquid detergent on the wall surface X—X which is located approximately 25–30 cm apart from the spraying member 20 in the forward direction when the liquid detergent is discharged with the collision plate being closed as shown in FIG. 19, the deposited state is observed as shown in the side view of FIG. 20 and the front view of FIG. 21. That is, in this case, the liquid detergent is deposited in a small range on the wall surface in the volumed foaming state.

<In Case of Upward Pivoting of the Collision Plate 50>

Figure 22:
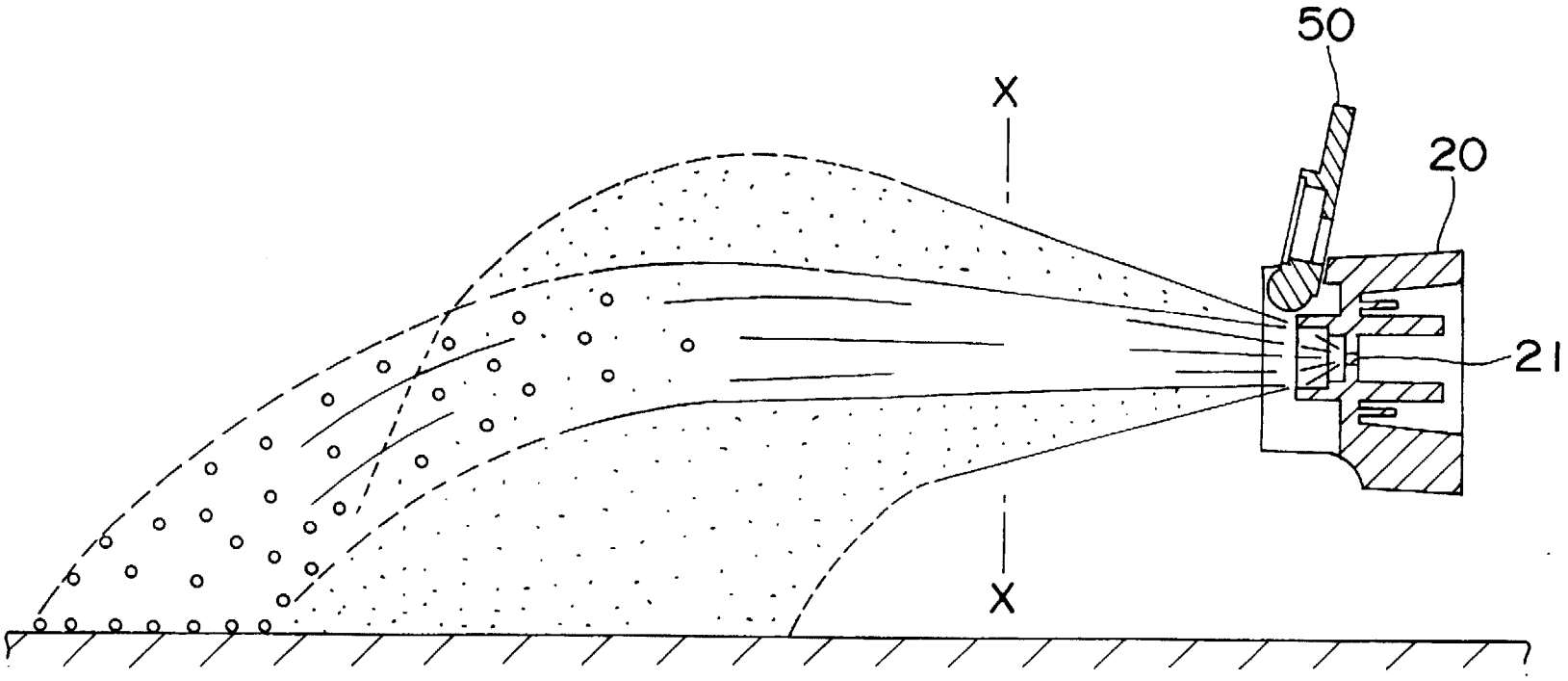
FIG. 22 is a view showing a spraying state of the sprayer of Example 2 when the collision plate is got away from a position in front of the discharge nozzle.

FIG. 22 shows a spray state of the sprayed liquid detergent when the collision plate 50 is pivoted upwardly to move away from a position in front of the discharge nozzle 21. In this case, the small-diameter concavity 33 and the large-diameter concavity 34 of the spraying member 20 form together a gas-liquid mixing passage. Therefore, the gas-liquid mixing passage has a whole length shorter than that in case of closing the collision plate 50.

Part of the sprayed particles of the liquid detergent sprayed from the discharge nozzle 21 become smaller particles and scatter by colliding with the inner surface of the gas-liquid mixing passage, and stir the flow in the gas-liquid mixing passage. However, since the collision plate 50 is removed in this case, the scatter of the sprayed particles is narrower than the case of closing the collision plate 50 and the effect of stirring in the gas-liquid mixing passage is also weak. Therefore, the liquid detergent is not so foamed by comparison with the case of closing the collision plate 50. The foams are mixed with the sprayed particles directly reached without colliding with the inner surface of the gas-liquid mixing passage and then discharged from the large-diameter concavity 34 of the spraying member 20.

Thus, since the distance between the discharge nozzle 21 and the front end of the gas-liquid mixing passage is short and the scattered angle is wide in case of removed the collision wall 50, the foam and the sprayed particles are scattered and sprayed from the large-diameter concavity 34.

Figure 23:
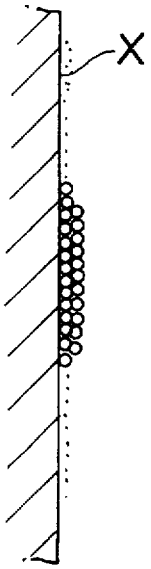
FIG. 23 is a side view showing the deposited state of the foam on the wall surface which is sprayed from the sprayer of Example 2 when the collision plate is got away from a position in front of the discharge nozzle.
Figure 24:
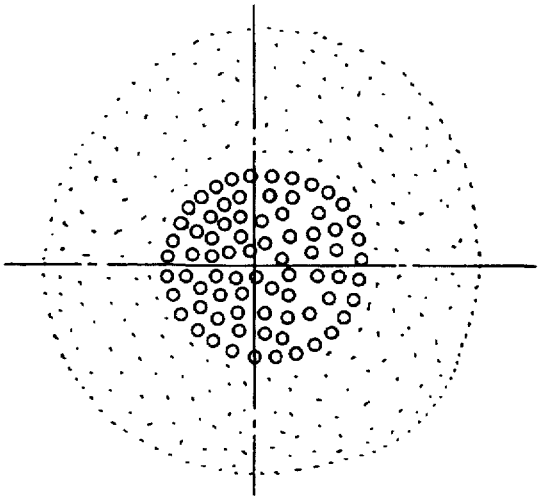
FIG. 24 is a front view showing the deposited state of the foam on the wall surface which is sprayed from the sprayer of Example 2 when the collision plate is got away from a position in front of the discharge nozzle.

As a result of observing the deposited state of the liquid detergent on the wall surface X—X which is located approximately 25–30 cm apart from the spraying member 20 in the forward direction when the liquid detergent is discharged with the collision plate being got away upward in the opened state as shown in FIG. 22, the deposited state is observed as shown in the side view of FIG. 23 and the front view of FIG. 24. That is, in this case, the liquid detergent is deposited in a wide range on the wall surface, the center of which is in the foamed state and the periphery of which is in the atomized state.

As described above, the sprayer according to this example, the collision plate 50 located to face the discharge nozzle 21 is disposed so that it can be removed from a position in front of the discharge nozzle 21, thereby allowing the selection whether the liquid is sprayed in the well foamed state or in the not-so-well foamed state.

When the collision plate 50 has the through hole 54 for substantially extending the gas-liquid mixing passage in case of disposing the collision plate 50 to face the discharge nozzle 21, the scattering of the foam sprayed out from the flow opening of the collision plate 50 can be reduced.

EXAMPLE 3

Figure 25:
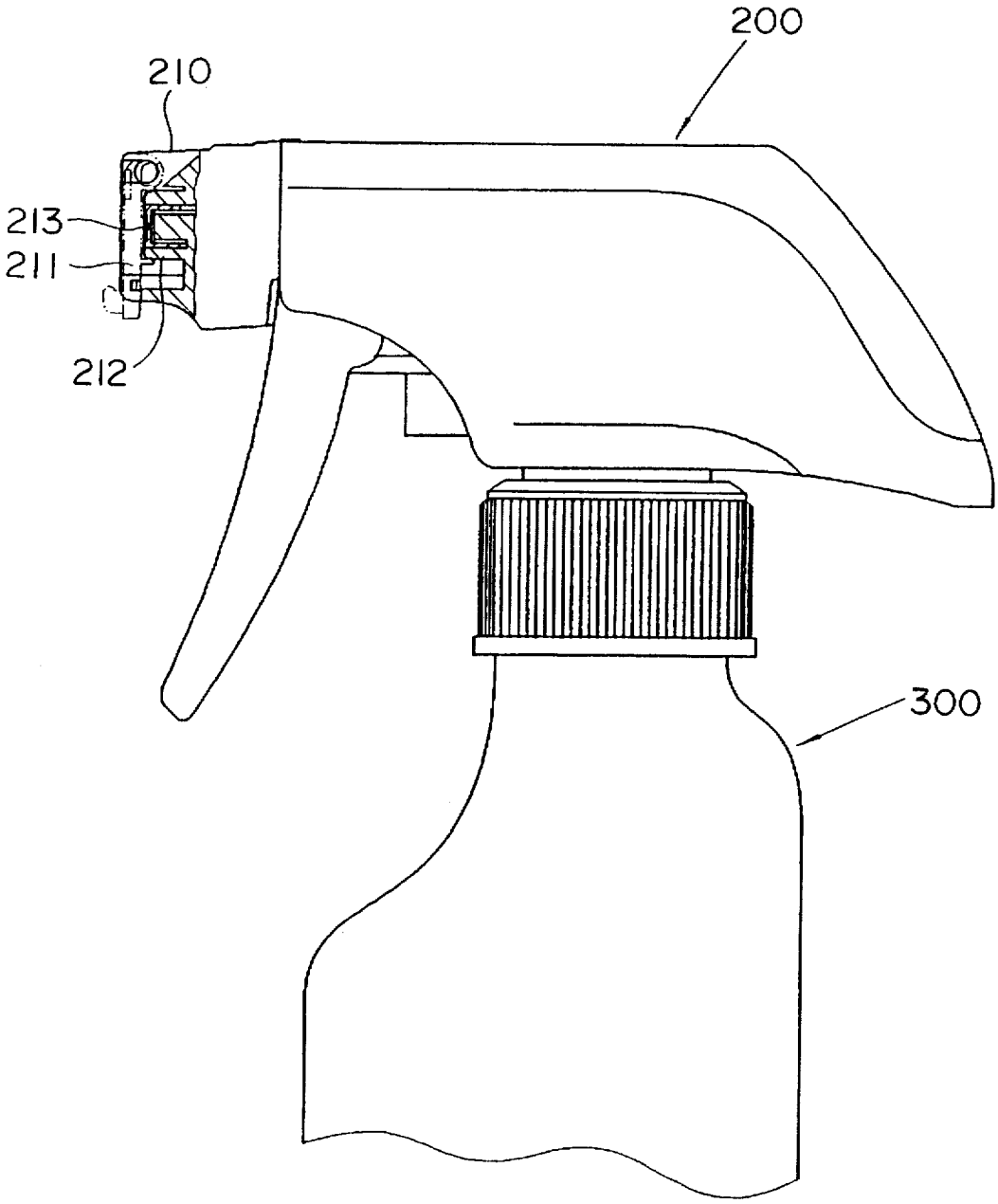
FIG. 25 is a side view showing a portion of a sprayer, partly sectioned, according to Example 3.

The description will now be made as regard to a sprayer according to Example 3 with referred to FIG. 25 through FIG. 29. FIG. 25 is a front view of the sprayer 200 partially sectioned. The sprayer 200 of this example is of the trigger type and is mounted to the neck of a container 300 for use. Both the sprayer 200 and the container 300 are made of synthetic resin.

The sprayer 200 has a spraying member 210, the outline of which is formed in an inverted triangle when seen from the front side, at the front end thereof. The spraying member 210 is provided with a cavity 211 formed in the front middle portion thereof. The cavity 211 is provided with a nozzle cylinder 212 protruding from the center thereof. A spraying outlet 213 for spraying out, which has a swirling passage therein, is provided in the center of the nozzle cylinder 212.

Figure 26:
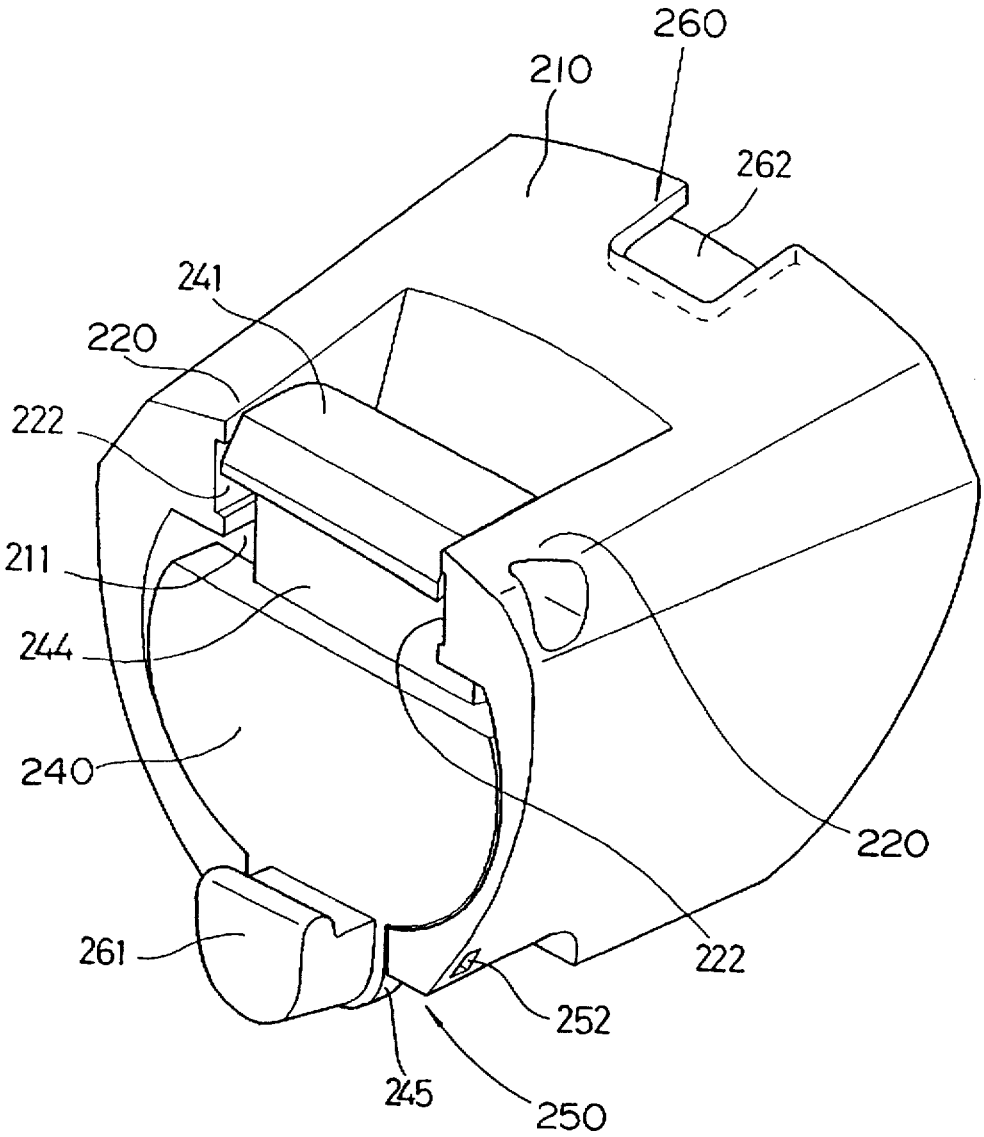
FIG. 26 is an assembled perspective view showing the closed state of the spraying outlet in the sprayer of Example 3.
Figure 27:
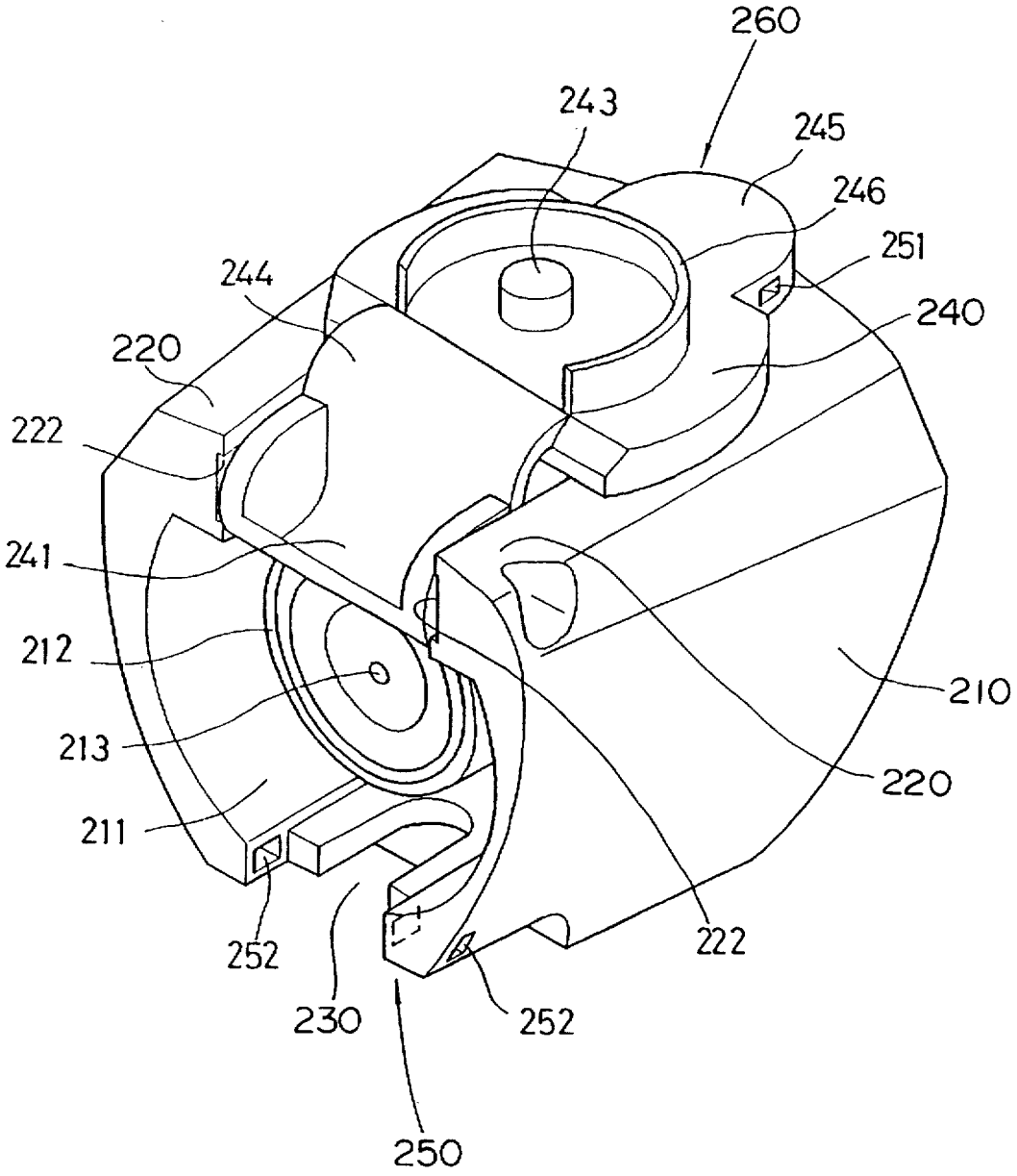
FIG. 27 is an assembled perspective view showing the opend state of the spraying outlet in the sprayer of Example 3.
Figure 28:
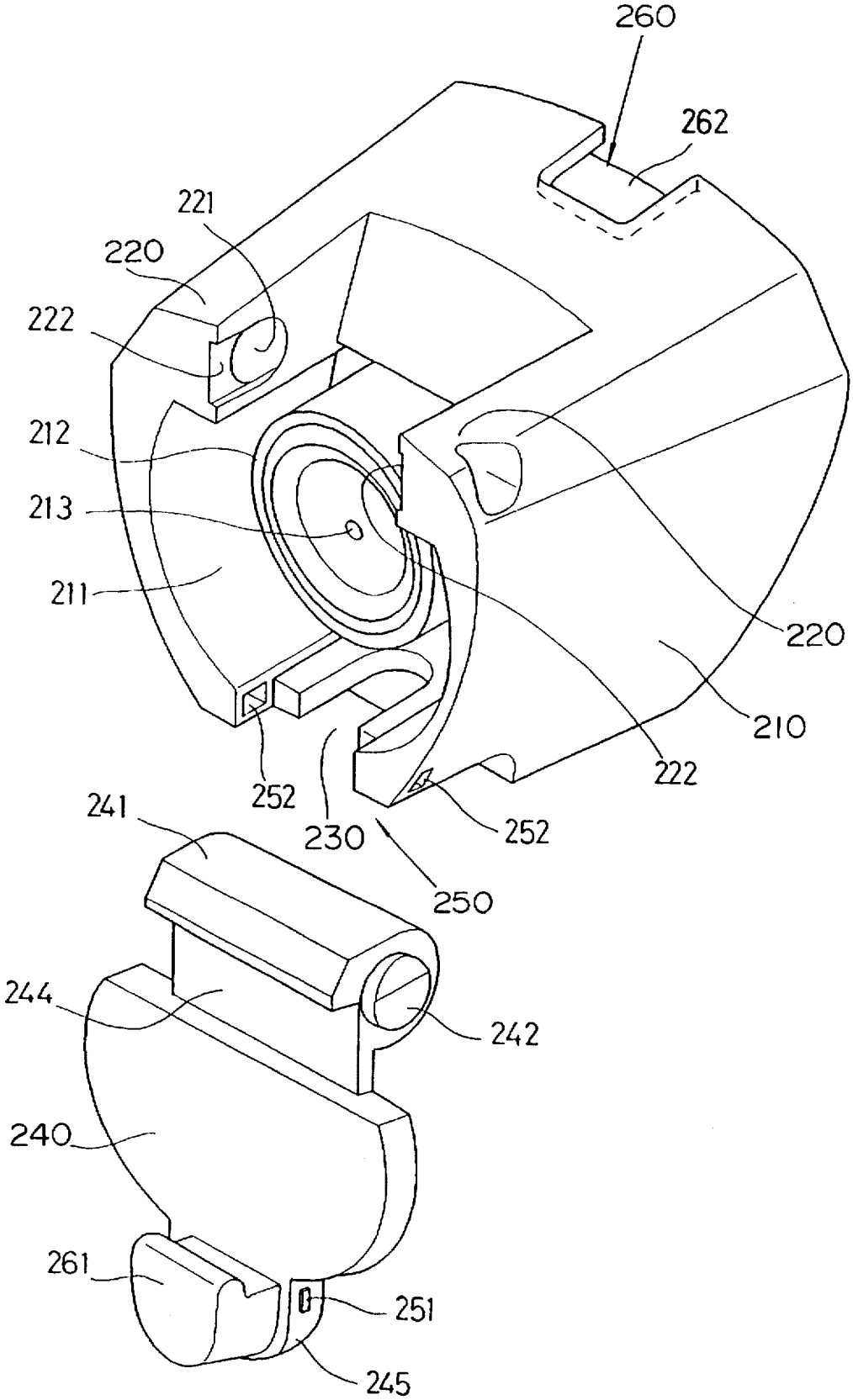
FIG. 28 is an exploded perspective view of the sprayer of Example 3.

As shown in FIG. 26 through FIG. 28, the spraying member 210 is widely cut out in the front upper portion thereof. A pair of bearings 220 is formed in both sides of the cut-out portion. On the side surfaces facing each other, shaft supporting holes 221 and insertion grooves 222 extending from the shaft supporting holes 221 to the front end of the spaying member 210 are formed.

The spraying member 210 is also cut out in the front lower portion thereof to have a cutout 230.

A nozzle cover 240 is detachably mounted to the cavity 211 of the spraying member 210 to cover the spraying outlet 213. To describe it in more detail, the nozzle cover 240 has a pair of pivot shafts 242 protruding from both sides of a base portion 241 thereof. The pivot shafts 242 is rotatably inserted in the shaft supporting holes 221, respectively, so that the nozzle cover 240 is pivotably supported by the spraying member 210. It should be noted that the pivot shafts 242 can be easily inserted into the shaft supporting holes 221 by fitting the pivot shafts 242 in the insertion grooves 222 and pushing them to the shaft supporting holes 221.

In the nozzle cover 240, a portion connected to the base portion 241 is formed to a hinge portion 244, connected to the base portion 241, which is thin and flexible.

The nozzle cover 240 has a closing projection 243 projecting from the inner surface center thereof for closing the spraying outlet 213, and an engaging protrusion 246 protruding from the inner surface thereof and formed in a nearly ring shape around the closing projection 243, for engaging with the outside of the nozzle cylinder 212.

The lower side of the nozzle cover 240 is formed to an engaging end 245 for detachably engaging with the cutout 230.

A first holding means 250 is disposed between the engaging end 245 and the cutout 230 for holding the spraying outlet 213 in the closed state.

The first holding means comprise a pair of engaging protrusions 251 protruding from both sides of the engaging end 245, and a pair of engaging holes 252 formed in the sides of the cutout 230 facing each other wherein the engaging protrusions 251 are engageable with and detachable from the engaging holes 252, respectively.

On the other hand, a second holding means 260 is disposed between the engaging end 245 and the top surface of the spraying member 210 for holding the spraying outlet 213 in the opened state.

The second holding means 260 comprises a hook 261 disposed on the outer surface of the engaging end 245 and an engaging concavity 262 formed in the top surface rear side of the spraying member 210 wherein the hook 261 is engageable with and detachable from the engaging concavity 262.

According to the sprayer 200 as structured above, when spraying is not needed, the nozzle cover 240 is closed and the engaging protrusions 251 of the first holding means 250 are engaged with the engaging holes 252, respectively, thereby holding the spraying outlet 213 in the closed state.

Figure 29:
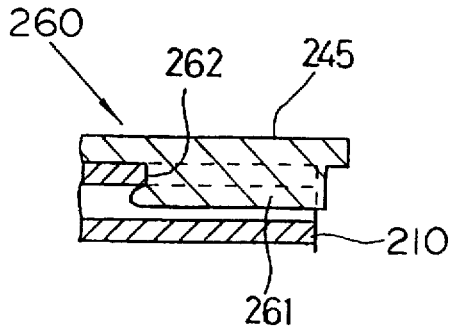
FIG. 29 is a vertical sectional view of a second holding means used in the sprayer of Example 3.

On the other hand, when spraying is needed, the first holding means 250 is released by detaching the engaging protrusions 251 from the engaging holes 252 and the nozzle cover 240 is pivoted upwardly and further pivoted rearwardly. The hook 261 of the second holding means 260 is then engaged with the engaging concavity 262 as shown in FIG. 29, thereby holding the spraying outlet 213 in the opened state.

FIG. 27 shows the sprayer 200 during the second holding means 260 is operated. When the second holding means 260 is operated as shown, there is no possibility of inadvertently pivoting the nozzle cover 240 downward thereby surely preventing the nozzle cover 240 from blocking the spraying. Therefore, the sprayed particles are not scattered in unexpected directions due to collision with the nozzle cover.

After spraying, the second holding means 260 is released, the nozzle cover 240 is pivoted downward, and the first holding means 250 is operated again.

The structures of the first holding means 250 and the second holding means 260 are quite simple structures so that a mold for molding them from synthetic resin can be easily manufactured at a low cost, thereby also reducing the production cost for the sprayer 200.

EXAMPLE 4

Figure 31:
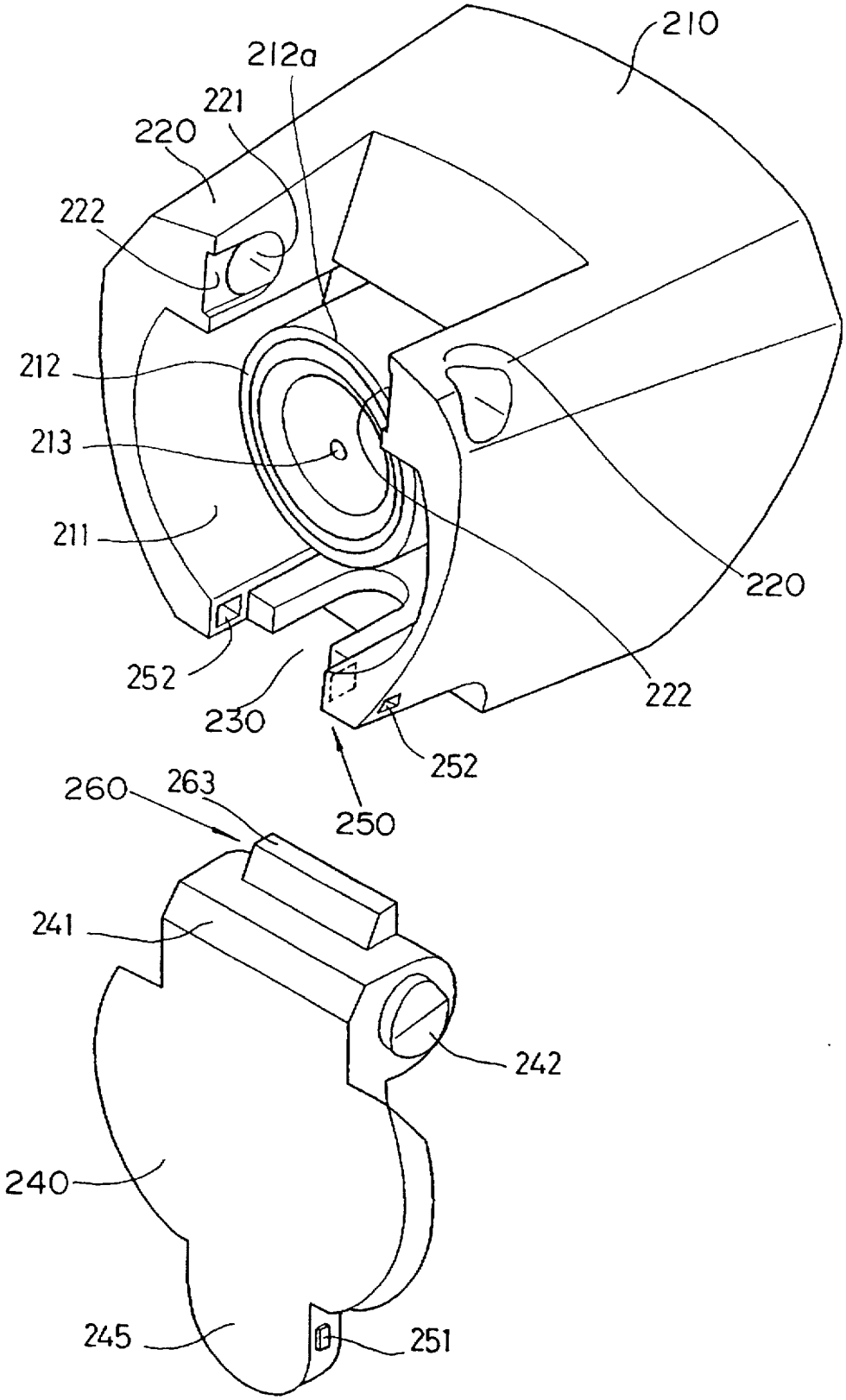
FIG. 31 is an exploded perspective view of the sprayer of Example 4.
Figure 32:
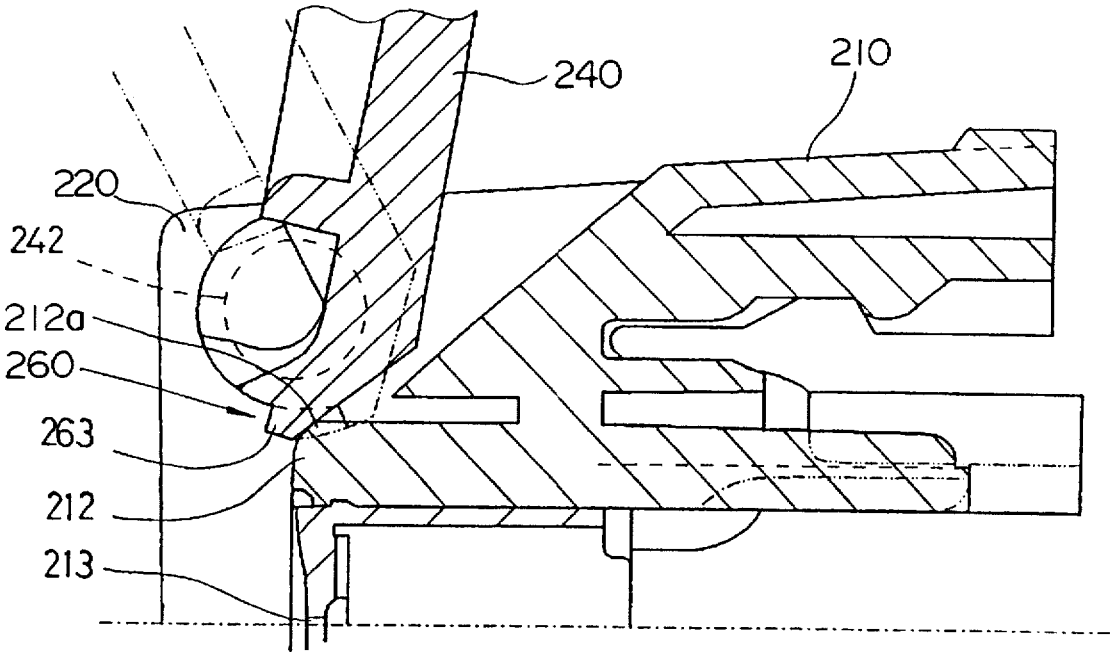
FIG. 32 is a vertical sectional view showing a main part of the sprayer of Example 4 with its spraying outlet opened.

The description will now be made as regard to a sprayer 200 according to Example 4 with referred to FIG. 30 through FIG. 32. It should be noted that the sprayer 200 of Example 4 is one of modified examples of the sprayer 200 of Example 3 so that the description will be made as regard only to the differences from Example 3, and the same parts as those of the sprayer 200 of the third embodiment will be marked by the same reference numerals, respectively, and the description about the same parts will be omitted.

In the sprayer 200 of Example 4, the nozzle cover 240 does not have the flexible hinge portion 244 so that the structure of the second holding means 260 is different.

In Example 4, the base portion 241 of the nozzle cover 240 has an engaging protrusion 263 protruding from the top surface thereof. When the nozzle cover 240 is pivoted upwardly and rearwardly, at the end of this pivotal movement, the engaging protrusion 263 passes over an upper edge 212*a* of the nozzle cylinder 212 of the spraying member 210 to hold the engaging protrusion 263 by the upper edge 212*a*, as shown in FIG. 32. In a state that the engaging protrusion 263 is held by the upper edge 212*a* of the nozzle cylinder 212 as mentioned above, there is no possibility of inadvertently pivoting the nozzle cover 240 downward.

As a result of this, the spraying outlet 213 can be held in the opened state for spraying and the second holding means 260 can securely prevent the nozzle cover 240 from blocking the spraying so that the sprayed particles are not scattered in unexpected directions due to collision with the nozzle cover 240.

That is, the second holding means 260 comprises the engaging protrusion 263 and the upper edge 212*a* of the nozzle cylinder 212 in Example 4.

Figure 30:
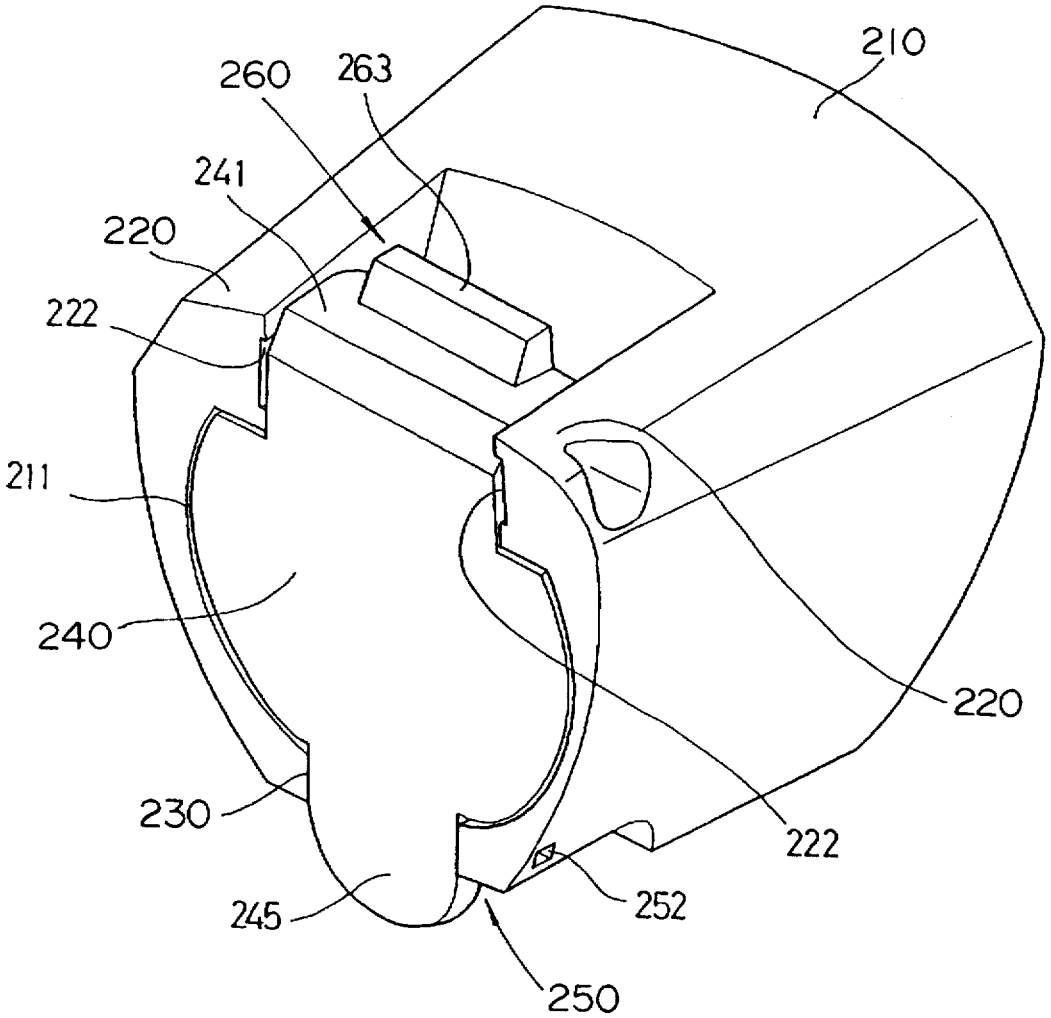
FIG. 30 is an assembled perspective view showing the closed state of the spraying outlet in the sprayer of Example 4.

When spraying is not needed, the second holding means 260 is released by pivoting the nozzle cover 240 forward to force the engaging protrusion 263 to pass over the upper edge 212*a* of the nozzle cylinder 212, and the first holding means 250 is operated by further pivoting the nozzle cover 240 downward as shown in FIG. 30.

The structures of the first holding means 250 and the second holding means 260 are quite simple so that a mold for molding them from synthetic resin can be easily manufactured at a low cost, thereby also reducing the production cost for the sprayer 200.

EXAMPLE 5

The description will now be made as regard to a sprayer 200 according to Example 5 with referred to FIG. 33 through FIG. 35. It should be noted that the sprayer 200 of Example 5 is one of modified examples of the sprayer 200 of Example 3 so that the description will be made as regard only to the differences from Example 3, and the same parts as those of the sprayer 200 of Example 3 will be marked by the same reference numerals, respectively, and the description about the same parts will be omitted.

In the sprayer 200 of Example 5, the nozzle cover 240 does not have the flexible hinge portion 244 so that the structure of the second holding means 260 is different.

Figure 35:
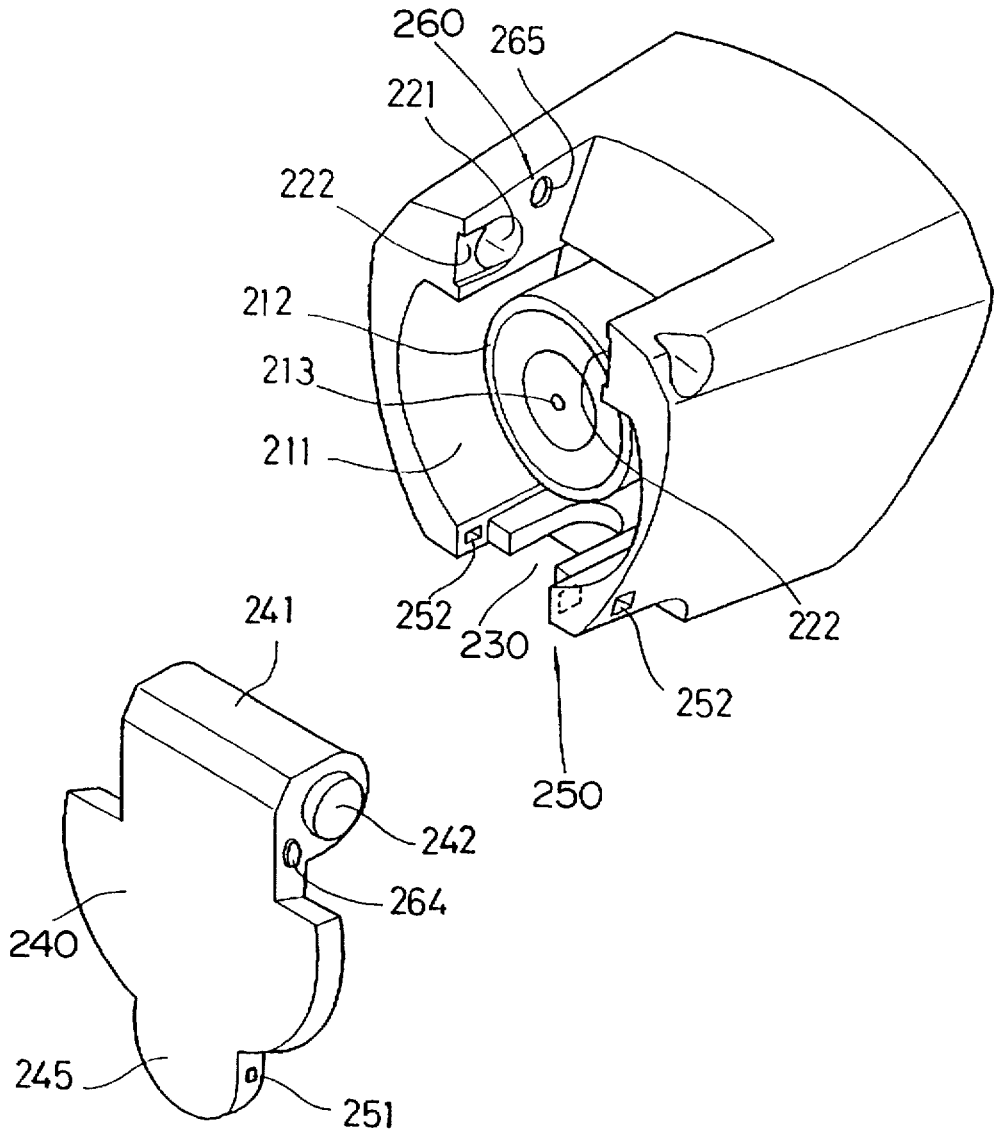
FIG. 35 is an exploded perspective view of a sprayer of Example 5.

In Example 5, as shown in FIG. 35, the base portion 241 of the nozzle cover 240 has a pair of engaging protrusions 264 protruding from both sides thereof and located beneath the pivot shafts 242, respectively, and the bearings 220 have engaging holes 265 formed in the side surfaces facing each other, wherein the engaging protrusions 264 are engageable with and detachable from the engaging holes 265. The second holding means 260 comprises the engaging protrusions 264 and the engaging holes 265 in Example 5.

Figure 34:
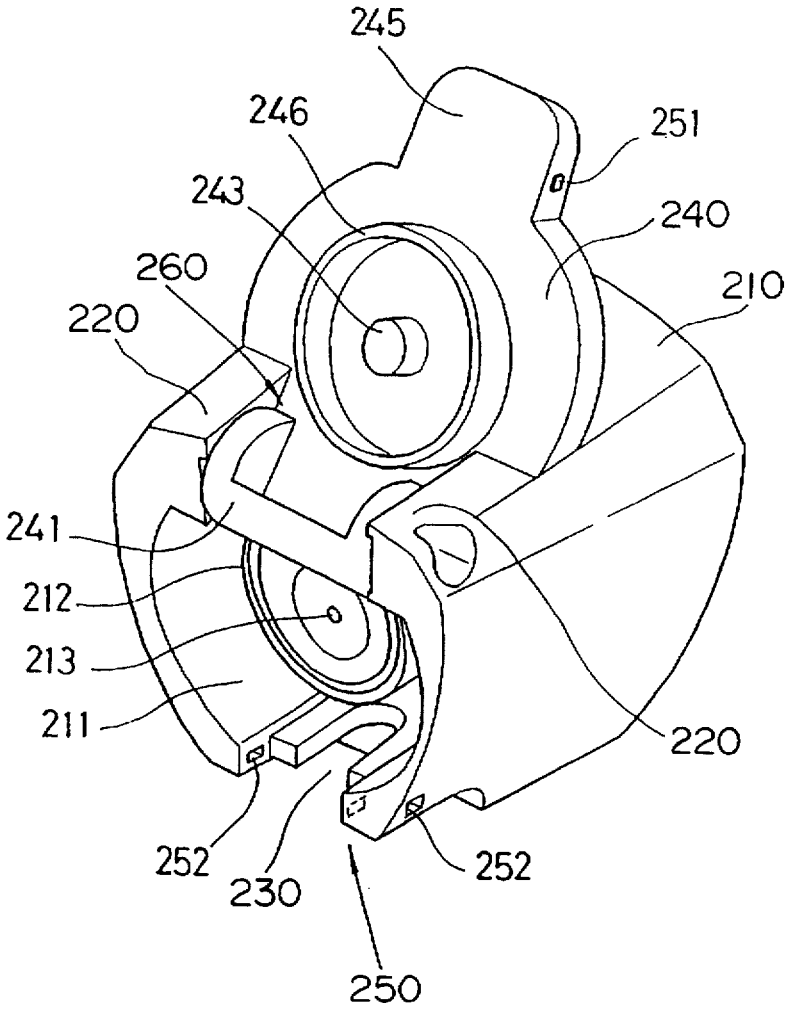
FIG. 34 is an assembled perspective view showing the opened state of the spraying outlet in the sprayer of Example 5.

For spraying, the engaging protrusions 264 of the second holding means 260 are engaged with the engaging holes 265 as shown in FIG. 34, by pivoting the nozzle cover 240 upwardly and rearwardly, in Example 5. When the second holding means 260 is operated as mentioned above, there is no possibility of inadvertently pivoting the nozzle cover 240 downward.

As a result of this, the spraying outlet 213 can be held in the opened state for spraying and the second holding means 260 can securely prevent the nozzle cover 240 from blocking the spraying so that the sprayed particles are not scattered in unexpected directions due to collision with the nozzle cover 240.

Figure 33:
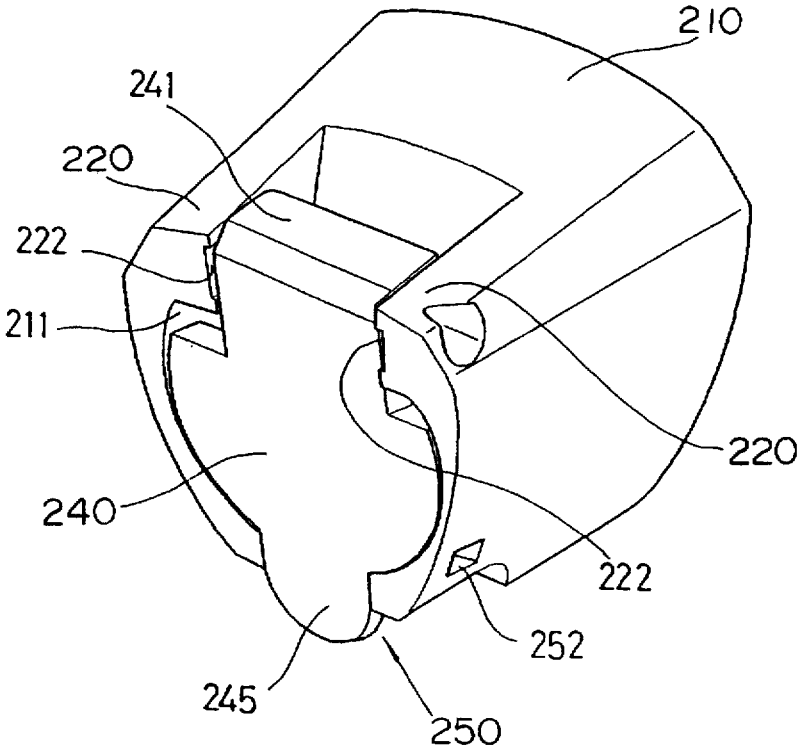
FIG. 33 is an assembled perspective view showing the closed state of the spraying outlet in the sprayer of Example 5.

When spraying is not needed, the second holding means 260 is released by pivoting the nozzle cover 240 forward, and the first holding means 250 is operated by further pivoting the nozzle cover 240 downward as shown in FIG. 33.

The structures of the first holding means 250 and the second holding means 260 are quite simple so that a mold for molding them from synthetic resin can be easily manufactured at a low cost, thereby also reducing the production cost for the sprayer 200.

EXAMPLE 6

The description will now be made as regard to a sprayer 200 according to Example 6 with referred to FIG. 36 through FIG. 38. It should be noted that the sprayer 200 of Example 6 is one of modified examples of the sprayer 200 of Example 3 so that the description will be made as regard only to the differences from Example 3, and the same parts as those of the sprayer 200 of Example 3 will be marked by the same reference numerals, respectively, and the description about the same parts will be omitted.

In the sprayer 200 of Example 6, the nozzle cover 240 does not have the flexible hinge portion 244 so that the structure of the second holding means 260 is different.

Figure 37:
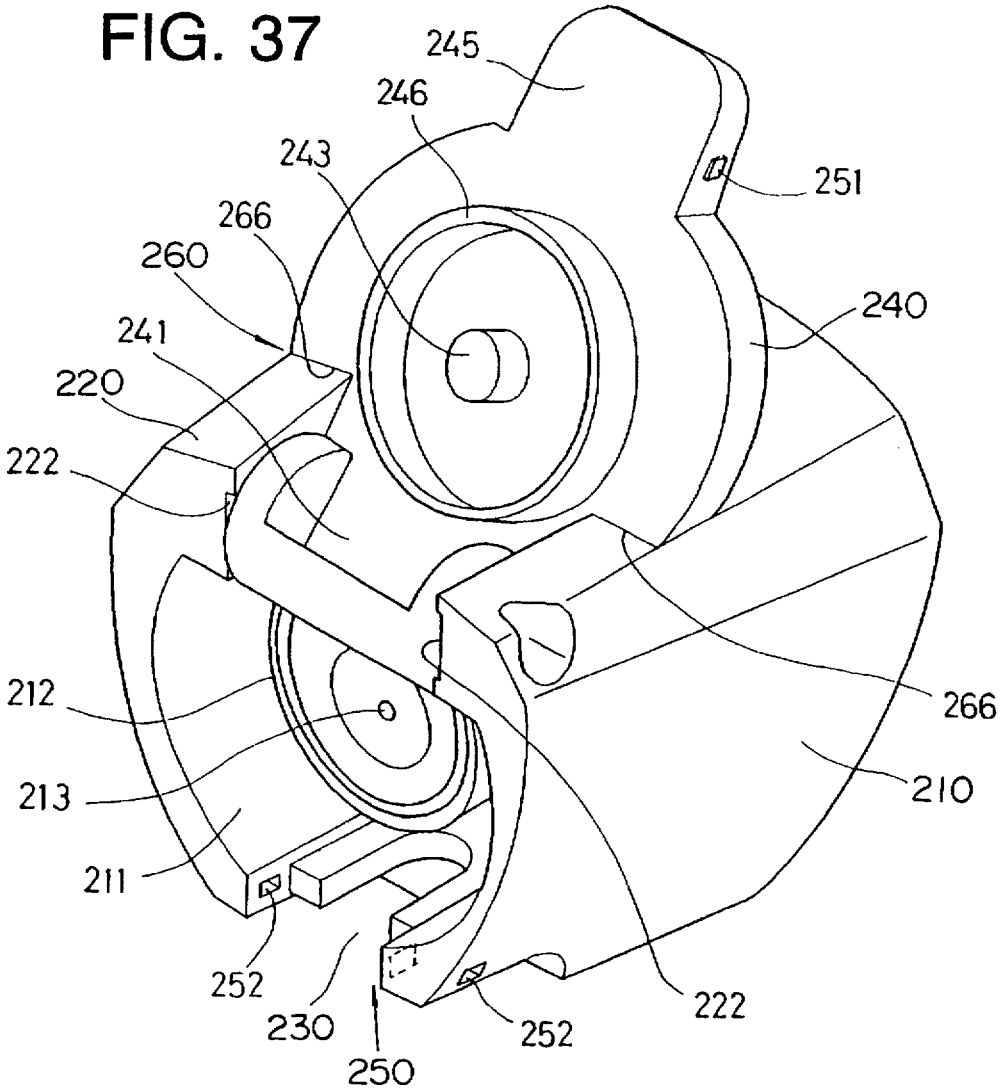
FIG. 37 is an assembled perspective view showing the opened state of the apraying outlet in the sprayer of Example 6.
Figure 38:
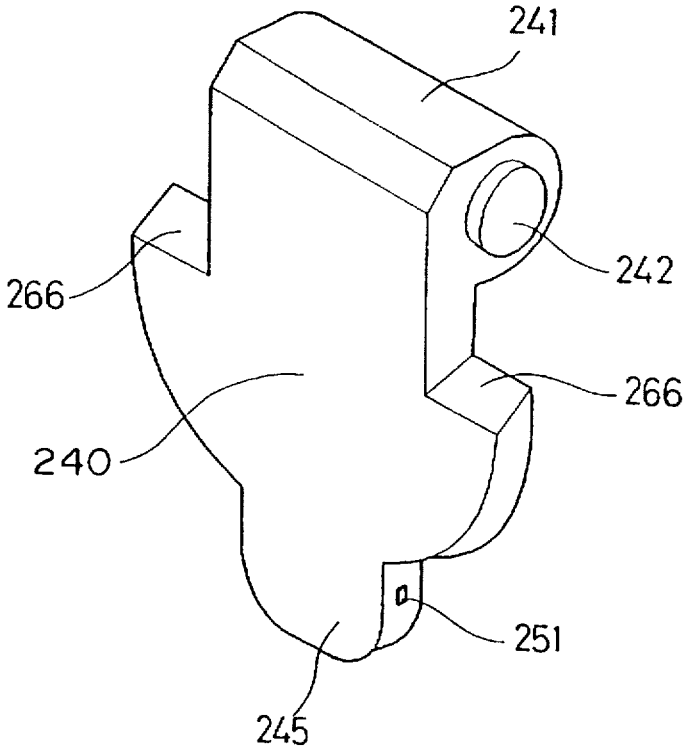
FIG. 38 is a perspective view of a nozzle cover used in the sprayer of Example 6.

In Example 6, the nozzle cover 240 has a pair of step portions 266 formed in the middle of both sides thereof, respectively, as shown in FIG. 38. When the nozzle cover 240 is pivoted upwardly and rearwardly, at the end of this pivotal movement, the nozzle cover 240 tilts rearwardly so that the step portions 266 sit on the top surfaces of both bearings 220, respectively, as shown in FIG. 37. In a state that the step portions 266 sit on the top surfaces of both bearings 220 as mentioned above, there is no possibility of inadvertently pivoting the nozzle cover 240 downward.

As a result of this, the spraying outlet 213 can be held in the opened state for spraying and the second holding means 260 can securely prevent the nozzle cover 240 from blocking the spraying so that the sprayed particles are not scattered in unexpected directions due to collision with the nozzle cover 240.

That is, the second holding means 260 comprises the step portions 266 and the top surfaces of the bearings 220 in Example 6.

Figure 36:
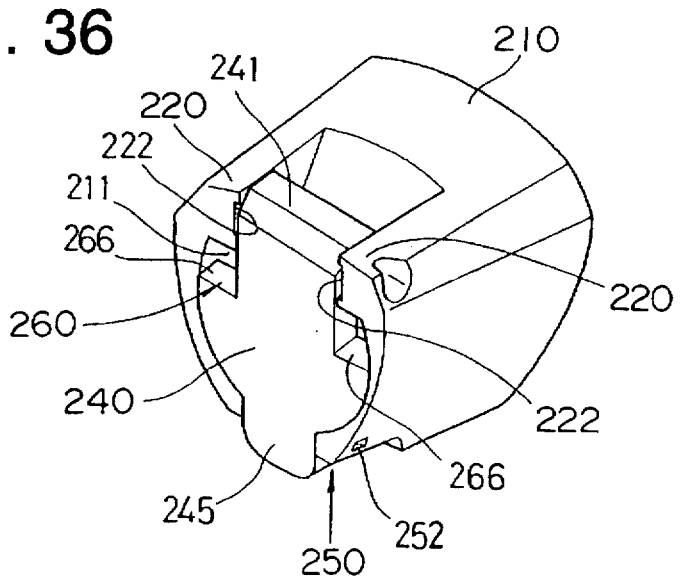
FIG. 36 is an assembled perspective view showing the closed state of the spraying outlet in the sprayer of Example 6.

When spraying is not needed, the first holding means 250 is operated by further pivoting the nozzle cover 240 forward and downward, as shown in FIG. 36.

The structures of the first holding means 250 and the second holding means 260 are quite simple so that a mold for molding them from synthetic resin can be easily manufactured at a low cost, thereby also reducing the production cost for the sprayer 200.

EXAMPLE 7

The description will now be made as regard to a sprayer 200 according to Example 7 with referred to FIG. 39 through FIG. 41. It should be noted that the sprayer 200 of Example 7 is one of modified examples of the sprayer 200 of Example 3 so that the description will be made as regard only to the differences from Example 3, and the same parts as those of the sprayer 200 of Example 3 will be marked by the same reference numerals, respectively, and the description about the same parts will be omitted.

In the sprayer 200 of Example 7, the nozzle cover 240 does not have the flexible hinge portion 244 so that the structure of the second holding means 260 is different.

Figure 39:
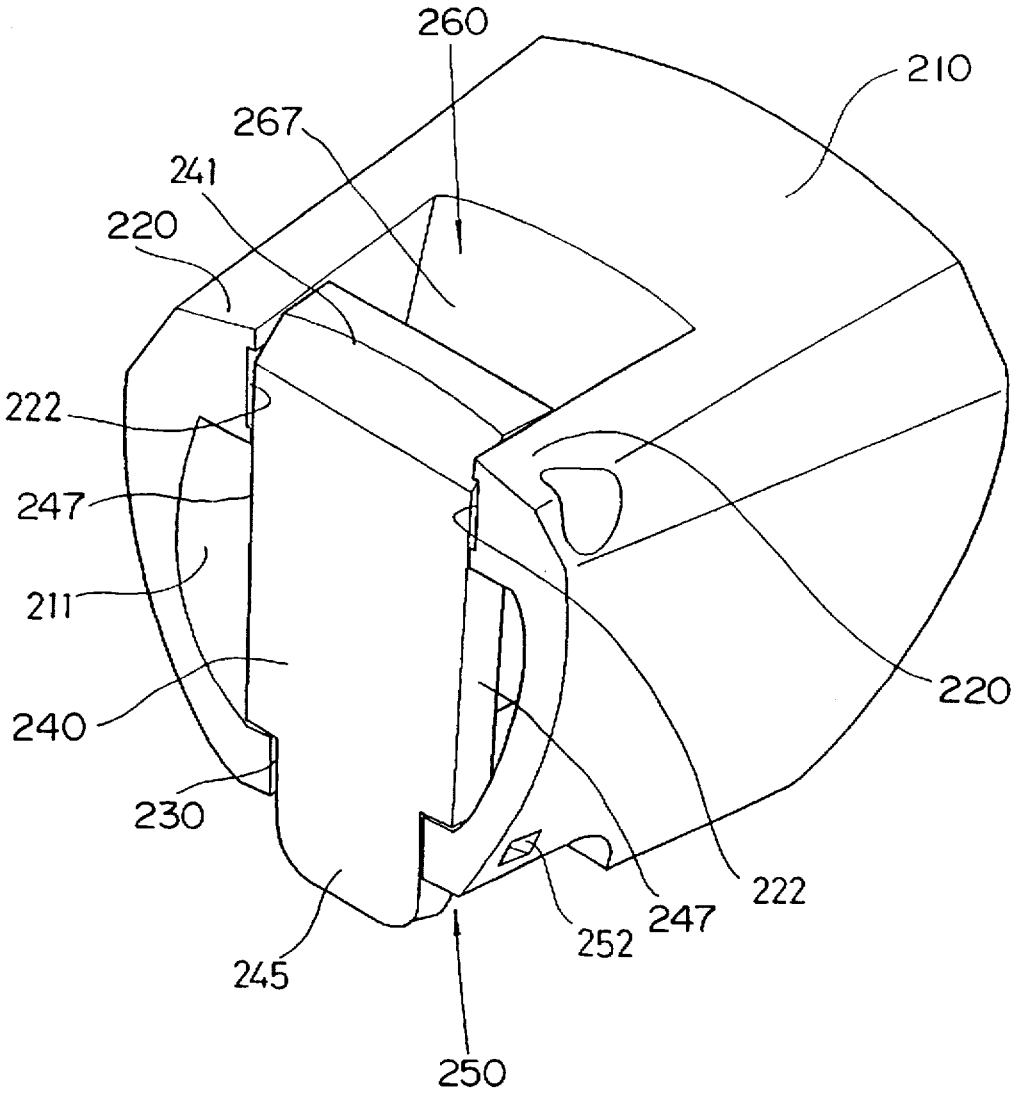
FIG. 39 is an assembled perspective view showing the closed state of the spraying outlet of the sprayer of Example 7.

In Example 7, as shown in FIG. 39, the cut-out portion has a deep hollow 267 at the rear side of the bearings 220 and the both sides of the nozzle cover 240 are cut to have parallel planes 247.

Figure 40:
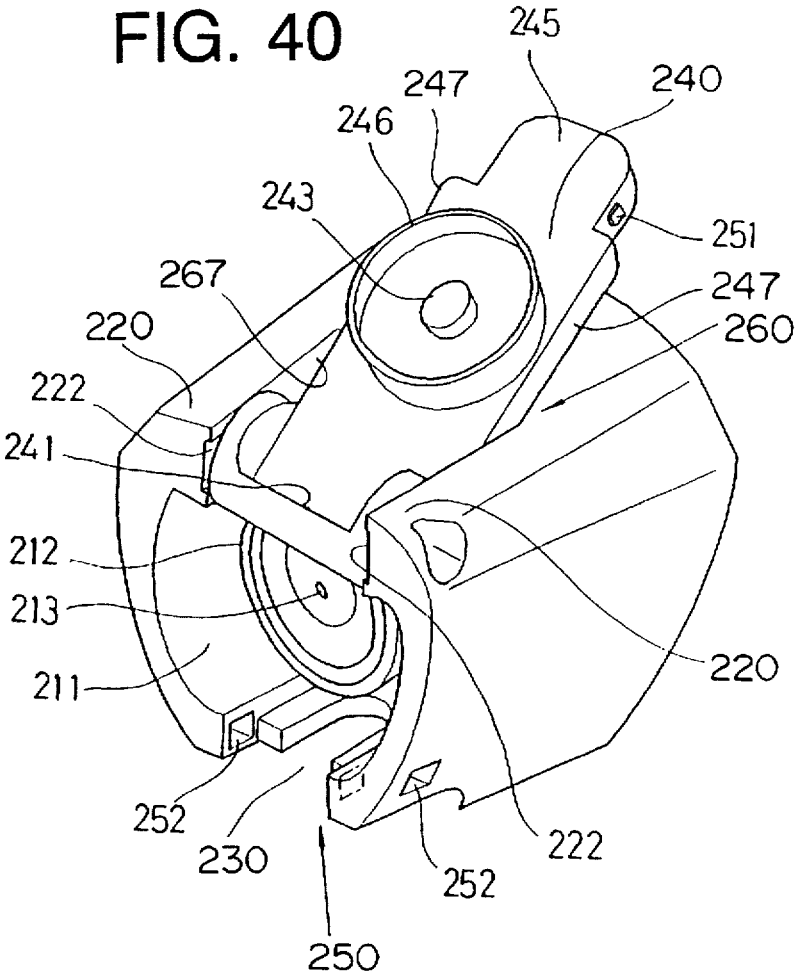
FIG. 40 is an assembled perspective view showing the opened state of the sprayer of Example 7.
Figure 41:
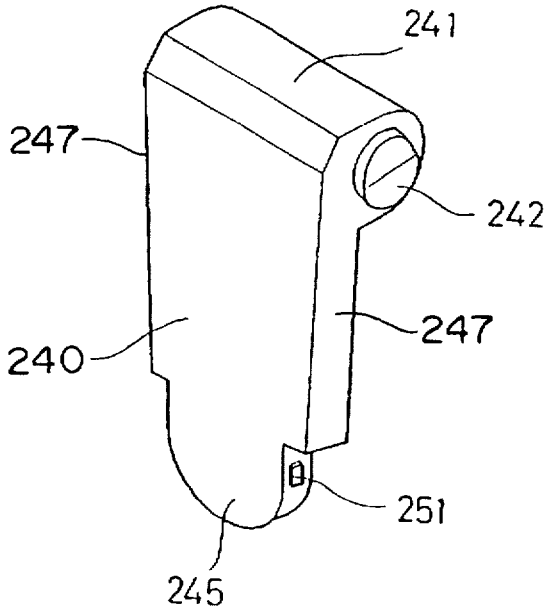
FIG. 41 is a perspective view of a nozzle cover used in the sprayer of Example 7.

When the nozzle cover 240 is pivoted upwardly and rearwardly, at the end of this pivotal movement, the nozzle cover 240 tilts rearwardly so that parts of the parallel planes 247 of the nozzle cover 240 are deeply inserted into the hollow 267 as shown in FIG. 40. In a state that the nozzle cover 240 tilts rearwardly and the parts of the parallel planes 247 of the nozzle cover 240 are deeply inserted into the hollow 267 as mentioned above, there is no possibility of inadvertently pivoting the nozzle cover 240 downward.

As a result of this, the spraying outlet 213 can be held in the opened state for spraying and the second holding means 260 can securely prevent the nozzle cover 240 from blocking the spraying so that the sprayed particles are not scattered in unexpected directions due to collision with the nozzle cover 240.

That is, the second holding means 260 comprises the parts of the parallel planes 247 and the hollow 267.

When spraying is not needed, the first holding means 250 is operated by further pivoting the nozzle cover 240 forward and downward as shown in FIG. 39.

The structures of the first holding means 250 and the second holding means 260 are quite simple so that a mold for molding them from synthetic resin can be easily manufactured at a low cost, thereby also reducing the production cost for the sprayer 200.

It should be noted that the second holding means 260 of the nozzle cover 240 described in Example 3 through Example 7 may be used as the means for holding the collision plate 50 in the upward position in the sprayer of Example 2.

INDUSTRIAL APPLICABILITY

The present invention may be available as a sprayer for spraying liquid, such as liquid detergent, liquid insecticide, or liquid for other purposes, in the atomized state or foamed state.

What is claimed is:

1. A sprayer comprising:

(a) a spraying member having a spraying outlet, (b) a cylinder, (c) a piston slidably inserted into said cylinder for sucking up liquid into the cylinder during the return motion, and spraying said liquid from a spraying outlet of said spraying member by pressing the liquid in said cylinder during the forward motion, and (d) a coil spring comprising a spirally wound coil wire disposed between said cylinder and said piston for energizing said piston in the returning direction, a portion extending a predetermined length from each end of said coil wire being deflected in a direction approaching a coil axis of said coil wire, and the deflected portion is positioned on a plane perpendicular or nearly perpendicular to the coil axis of said coil wire.

2. A sprayer according to claim 1, wherein said coil spring is set to satisfy the formula:

$$s \geqq 0.5d$$

wherein s is a deflection length of each end of said coil wire to the coil axis, and d is a wire diameter of said coil wire.

3. A sprayer for spraying foamable liquid in the foamed state, comprising:

(a) a discharge nozzle, (b) a swirling passage disposed at an upstream side of said discharge nozzle to communicate with said discharge nozzle for swirling the liquid, (c) a gas-liquid mixing passage concentrically disposed at a downstream side of said discharge nozzle to communicate with said discharge nozzle, (d) an air inlet for allowing air to enter into said gas-liquid mixing passage, and (e) a collision plate having a collision portion and a flow opening and disposed at a downstream side of said gas-liquid mixing passage to face said discharge nozzle, said collision plate being movable away from a position in front of said discharge nozzle, wherein said discharge member, said swirling passage, said gas-liquid mixing passage and said air inlet form a front end member, said collision plate being mounted to said front end member.

4. A sprayer according to claim 3, wherein said collision plate comprises an extending passage for substantially extending said gas-liquid mixing passage in case of disposing said collision plate to face said discharge nozzle, and said collision portion and said flow opening are disposed at a downstream side of said extending passage.

5. A sprayer according to claim 3, wherein said collision portion of said colloision plate comprises a plurality of bar-like collision walls extending toward a point on an extension of the center of said discharge nozzle, and said flow opening is disposed among the bar-like collision walls and on the extension of the center of the discharge nozzle.

6. A sprayer comprising:

(a) a spraying member having a spraying outlet at the center of the front thereof, a pair of bearings disposed on right and left sides at the upper front thereof, and a cutout formed at the lower front thereof, (b) a nozzle cover disposed to a front portion of said spraying member, said nozzle cover having a base portion pivotably mounted to said bearings of said spraying member so that said nozzle cover can be opened and closed, an engaging end disposed to a tip end portion thereof which is engageable and detachable to said cutout of said spraying member, a thin and flexible hinge portion disposed between said base portion and said tip end portion, said nozzle cover covering said spraying outlet of said spraying member when it is in the closed state, and getting away form a position in front of said spraying outlet when it is in the opened state, (c) a first holding means comprising an engaging protrusion and an engaging hole which are engageable each other and disposed on said cutout of said spraying member and said engaging end of said nozzle cover, respectively, for holding said nozzle cover in the closed state upon engagement thereof, and (d) a second holding means comprising a hook disposed on an outer surface of said engaging end of said nozzle cover and an engaging concavity disposed on a top surface of said spraying member which is engageable to said hook, for holding said nozzle cover in the opened state upon engagement thereof.

7. A sprayer comprising:

(a) a spraying member having a spraying outlet at the center of the front thereof, a pair of bearings disposed on right and left sides at the upper front thereof, and a cutout formed at the lower front thereof, (b) a nozzle cover disposed to a front portion of said spraying member, said nozzle cover having a base portion pivotably mounted to said bearings of said spraying member so that said nozzle cover can be opened and closed, and an engaging end disposed to a tip end portion thereof which is engageable and detachable to said cutout of said spraying member, said nozzle cover covering said spraying outlet of said spraying member when it is in the closed state, and getting away from a position in front of said spraying outlet when it is in the opened state, (c) a first holding means comprising an engaging protrusion and an engaging hole which are engageable each other and disposed on said cutout of said spraying member and said engaging end of said nozzle cover, respectively, for holding said nozzle cover in the closed state upon engagement thereof, and (d) a second holding means comprising an engaging protrusion disposed on an outer surface of said base portion of said nozzle cover and a front edge of said spraying member, wherein when said nozzle cover is pivoted to be opened, at the end of this pivotal movement, said engaging protrusion can pass over said front edge, for holding said nozzle cover in the opened state.

8. A sprayer comprising:

(a) a spraying member having a spraying outlet at the center of the front thereof, a pair of bearings disposed on right and left sides at the upper front thereof, and a cutout formed at the lower front thereof, (b) a nozzle cover disposed to a front portion of said spraying member, said nozzle cover having a base portion pivotably mounted to said bearings of said spraying member so that said nozzle cover can be opened and closed, and an engaging end disposed to a tip end portion thereof which is engageable and detachable to said cutout of said spraying member, said nozzle cover covering said spraying outlet of said spraying member when it is in the closed state, and getting away from a position in front of said spraying outlet when it is in the opened state, (c) a first holding means comprising an engaging protrusion and an engaging hole which are engageable each other and disposed on said cutout of said spraying member and said engaging end of said nozzle cover, respectively, for holding said nozzle cover in the closed state upon engagementh thereof, and (d) a second holding means comprising engaging protrusions and engaging holes which are engageable to each other and are disposed on side surfaces of said base portion of said nozzle cover and on the inner surfaces of said bearings of said spraying member, respectively, for holding said nozzle cover in the opened state upon engagement thereof.

9. A sprayer comprising:

(a) a spraying member having a spraying outlet at the center of the front thereof, a pair of bearings disposed on right and left sides at the upper front thereof, and a cutout formed at the lower front thereof, (b) a nozzle cover disposed to a front portion of said spraying member, said nozzle cover having a base portion pivotably mounted to said bearings of said spraying member so that said nozzle cover can be opened and closed, and an engaging end disposed to a tip end portion thereof which is engageable and detachable to said cutout of said spraying member, said nozzle cover covering said spraying outlet of said spraying member when it is in the closed state, and getting away from a position in front of said spraying outlet when it is in the opened state, (c) a first holding means comprising an engaging protrusion and an engaging hole which are engageable each other and disposed on said cutout of said spraying member and said engaging end of said nozzle cover, respectively, for holding said nozzle cover in the closed state upon engagement thereof, and (d) a second holding means comprising step portions disposed on both sides in the middle of said nozzle cover and top surfaces of said bearings of said spraying member, wherein when said nozzle cover is pivoted to be opened, at the end of this pivotal movement, said step portions sit on said top surfaces, thereby inclining backward said nozzle cover to hole said nozzle cover in the opened state.

10. A sprayer comprising:

(a) a spraying member having a spraying outlet at the center of the front thereof, a pair of bearings disposed on right and left sides at the upper front thereof, and a cutout formed at the lower front thereof, (b) a nozzle cover disposed to a front portion of said spraying member, said nozzle cover having a base portion pivotably mounted to said bearings of said spraying member so that said nozzle cover can be opened and closed, and an engaging end disposed to a tip end portion thereof which is engageable and detachable to said cutout of said spraying member, said nozzle cover covering said spraying outlet of said spraying member when it is in the closed state, and getting away from a position in front of said spraying outlet when it is in the opened state, (c) a first holding means comprising an engaging protrusion and an engaging hole which are engageable each other and disposed on said cutout of said spraying member and said engaging end of said nozzle cover, respectively, for holding said nozzle cover in the closed state upon engagement thereof, and (d) a second holding means comprising a hollow formed at a rear side of the bearings, wherein when said nozzle cover is pivoted to be opened, at the end of this pivotal movement, said nozzle cover tilts rearwardly so that part of said nozzle cover is inserted into said hollow, thereby holding said nozzle cover in the opened state.

* * * * *